US012618587B1

(12) United States Patent
Curran et al.

(10) Patent No.: US 12,618,587 B1
(45) Date of Patent: May 5, 2026

(54) CONDENSATE MANAGEMENT APPARATUS AND SYSTEM

(71) Applicants: James P Curran, West Nyack, NY (US); Christopher J Curran, West Nyack, NY (US)

(72) Inventors: James P Curran, West Nyack, NY (US); Christopher J Curran, West Nyack, NY (US)

( * ) Notice: Subject to any disclaimer, the term of this patent is extended or adjusted under 35 U.S.C. 154(b) by 250 days.

(21) Appl. No.: 18/594,516

(22) Filed: Mar. 4, 2024

(51) Int. Cl.
*F24F 13/22* (2006.01)
*F24F 11/52* (2018.01)
*F24F 140/30* (2018.01)

(52) U.S. Cl.
CPC ..... *F24F 13/222* (2013.01); *F24F 11/52* (2018.01); *F24F 2140/30* (2018.01)

(58) Field of Classification Search
CPC . F24F 13/222; F24F 2013/227; F04B 23/026; F04B 23/028; F04D 13/16
See application file for complete search history.

(56) References Cited

U.S. PATENT DOCUMENTS

| | | | | |
|---|---|---|---|---|
| 3,758,236 | A | 9/1973 | Zimmerman | |
| D240,530 | S | 7/1976 | Kubik | |
| D309,571 | S | 7/1990 | Lehman | |
| 5,392,944 | A | 2/1995 | Jennings | |
| 6,322,326 | B1 | 11/2001 | Davis | |
| D523,517 | S | 6/2006 | Flick | |
| D617,067 | S | 6/2010 | Renner | |
| D771,970 | S | 11/2016 | Mirth | |
| D891,192 | S | 7/2020 | D'Abundo | |
| 10,753,641 | B2 | 8/2020 | Rowland | |
| D937,000 | S | 11/2021 | Xia | |
| 11,680,730 | B2 * | 6/2023 | Forshaw | F04B 53/003 417/363 |
| 2006/0144071 | A1 | 7/2006 | Rowland | |
| 2009/0053073 | A1 | 2/2009 | Ward | |
| 2009/0129939 | A1 * | 5/2009 | Hampton | F04B 53/08 417/40 |
| 2016/0265795 | A1 | 9/2016 | Kopp | |
| 2017/0363317 | A1 | 12/2017 | Constable | |
| 2022/0205679 | A1 | 6/2022 | Cates | |
| 2022/0316718 | A1 | 10/2022 | Li | |
| 2023/0383988 | A1 * | 11/2023 | Sterling | F24F 13/222 |

* cited by examiner

*Primary Examiner* — Reinaldo Sanchez-Medina
(74) *Attorney, Agent, or Firm* — Goldstein Law Offices, P.C.

(57) ABSTRACT

A condensate management apparatus and system is presented to manage condensate from an HVAC system in the event of a condensate pump failure. The apparatus includes a modified pump collection tank having multiple outer walls extending perpendicularly between a periphery of the base and the top edge. An elevated platform is disposed in the modified pump collection tank and includes a support surface configured to support a conventional condensate pump assembly. One or more sidewalls of the elevated platform extends perpendicularly between the base and the support surface. A trough is defined by the sidewall and the outer walls and is configured to retain condensate from the HVAC system in the event the conventional condensate pump assembly fails. A drain outlet is disposed in the outer wall and is in fluid communication with the trough to direct liquid condensate towards an auxiliary condensate pump assembly.

7 Claims, 16 Drawing Sheets

CONDENSATE MANAGEMENT APPARATUS AND SYSTEM

TECHNICAL FIELD

The present disclosure relates generally to condensate pumps for heating, ventilation, and air conditioning (HVAC) systems. More particularly, the present disclosure relates to a novel condensate pump assembly system designed to divert condensate from a failed condensate pump to a functional auxiliary condensate pump, thereby mitigating potential issues such as heat loss, frozen pipes, and flooding.

BACKGROUND

Conventional HVAC systems rely on condensate pumps to manage and remove excess liquid condensate produced during the heating and cooling process. The condensate pump plays a crucial role in maintaining optimal functioning of the entire HVAC system. However, when this pump malfunctions or fails, it can lead to severe consequences, including a disrupted heat supply, frozen pipes, and potential flooding.

The absence of a fail-safe mechanism for condensate pumps in existing HVAC systems failures poses significant risks. In some instances, failure of a condensate pump may result in an automatic shutdown of the HVAC system, leading to uncomfortable indoor temperatures and potential damage to the building infrastructure. In systems without an automatic shut-off feature, continuous condensate production can overwhelm the non-functioning pump, causing overflow and potential flooding.

Existing solutions tend to involve complex and expensive HVAC system modifications, rendering them impractical for widespread adoption or retrofitting. Accordingly, there is a need for a cost-effective, simple, and easily implemented solution that addresses the shortcomings of current HVAC condensate pump failure scenarios. Further what is needed is a novel condensate management system that is compatible with existing HVAC systems, allowing for easy integration without the need for extensive modifications or additional wiring. Beneficially, such a system would prevent potential disruptions in heat supply, minimize the risk of frozen pipes, and eliminate the potential for flooding in the event of a condensate pump failure.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

According to one aspect of the present disclosure, a condensate management apparatus is presented to manage condensate from an HVAC system in the event of a condensate pump failure. The apparatus includes a modified pump collection tank having a base, a top edge, and multiple outer walls extending perpendicularly between a periphery of the base and the top edge.

An elevated platform is disposed in the modified pump collection tank and includes a support surface and at least one sidewall extending substantially perpendicularly between the base and the support surface. The support surface is configured to support a conventional condensate pump assembly of an HVAC system such that at least a portion of the conventional condensate pump assembly is elevated above the top edge. A trough is disposed within the modified pump collection tank and defined by the sidewall and the outer walls. The trough is configured to retain liquid condensate from the HVAC system in the event the conventional condensate pump fails. A drain outlet is disposed in one of the outer walls and is in fluid communication with the trough to direct the liquid condensate towards an auxiliary condensate pump assembly.

In some embodiments, the drain outlet is substantially aligned with the support surface. In certain embodiments, the drain outlet is in fluid communication with the auxiliary condensate pump assembly via an inlet port. The drain outlet may be elevated relative to the inlet port such that the condensate moves towards the auxiliary condensate pump assembly via gravity.

In some embodiments, the elevated platform substantially surrounds the elevated platform and the conventional condensate pump assembly. In some embodiments, a float assembly is coupled to the conventional condensate pump assembly and disposed in the trough. The float assembly may be configured to trigger an alarm in response to a level of the liquid condensate exceeding a predetermined threshold. In certain embodiments, the alarm includes an audible alarm, an electronic notification, and/or a telephone call.

According to another aspect of the present disclosure, a condensate management system is presented to manage condensate from an HVAC system in the event of a condensate pump failure. The condensate management system includes a modified pump collection tank configured to retain condensate from an HVAC system, a conventional condensate pump assembly, a drain outlet, and an auxiliary condensate pump assembly. The modified pump collection tank includes a base having a periphery, a top edge, and multiple outer walls including an optimized height. Each of the outer walls extends substantially vertically between the periphery and the top edge. The conventional condensate pump assembly is coupled to the modified pump collection tank and configured to collect the liquid condensate. The drain outlet is disposed in one of the outer walls and is elevated relative to the base and proximate the top edge. The auxiliary condensate pump assembly is in fluid communication with the drain outlet and configured to receive an overflow of the liquid condensate from the modified pump collection tank in the event that a level of the liquid condensate within the modified pump collection tank exceeds a predetermined level.

In some embodiments, the auxiliary condensate pump assembly includes an inlet port and the drain outlet is elevated relative to the inlet port. In some embodiments, the conventional condensate pump assembly and the auxiliary condensate pump assembly are substantially aligned along a longitudinal axis.

In some embodiments, the conventional condensate pump assembly includes a float assembly having an optimized length such that at least a portion of the float assembly is disposed substantially adjacent to the base of the modified pump collection tank.

According to another aspect of the present disclosure, a condensate management system to manage liquid condensate from an HVAC system in the event of a condensate pump failure includes a modified pump collection tank configured to retain liquid condensate from an HVAC system. The modified pump collection tank includes a base having a periphery, a top edge, and a plurality of outer walls extending substantially vertically between the periphery and the top edge.

The condensate management system further includes an overflow wall disposed between opposing outer walls of the plurality of outer walls. The overflow wall defines within the modified pump collection tank a first compartment configured to house a conventional condensate pump assembly and a second compartment configured to house an auxiliary condensate pump assembly. An overflow of the liquid condensate flows from the first compartment to the second compartment in the event the conventional condensate pump assembly fails.

In some embodiments, the first compartment is aligned with the second compartment along a longitudinal axis. The overflow wall may substantially bifurcate the modified pump collection tank. In some embodiments, the overflow wall includes a height less than a height of the top edge. In certain embodiments, the overflow wall includes a recessed portion configured to direct the overflow from the first compartment to the second compartment in response to a level of the liquid condensate in the first compartment exceeding a height of the recessed portion. In some embodiments, the overflow moves into the second compartment via gravity.

In some embodiments, the overflow wall includes a channel disposed between the first compartment and the second compartment. The channel may be configured to direct the overflow from the first compartment to the second compartment in response to a level of the liquid condensate in the first compartment exceeding a height of the channel.

In some embodiments, the condensate management system further includes a float assembly coupled to the conventional condensate pump assembly and/or the auxiliary condensate pump assembly. The float assembly includes an alarm configured such that the alarm is triggered in response to a level of the liquid condensate within the modified pump collection tank exceeding a predetermined level.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

As discussed above, condensate pumps play a crucial role in maintaining optimal functioning of an HVAC system. When a condensate pump fails, the consequences can be disastrous. A failed condensate pump may result in a disrupted heat supply, frozen pipes, and/or potential flooding, for example. The condensate management apparatus and system disclosed herein represent a significant advancement in the field of HVAC systems by addressing these and other issues.

As used herein, the term "condensate" or "liquid condensate" refers to any liquid produced by condensation of a gas or vapor from any source. The term "HVAC system" refers to any system where liquid condensate is formed, including an air conditioning system and/or boiler system, for example. The term "pump assembly" refers generically to a condensate pump of an HVAC system and may include either the conventional condensate pump assembly or the auxiliary condensate pump assembly disclosed herein.

Figure 1:
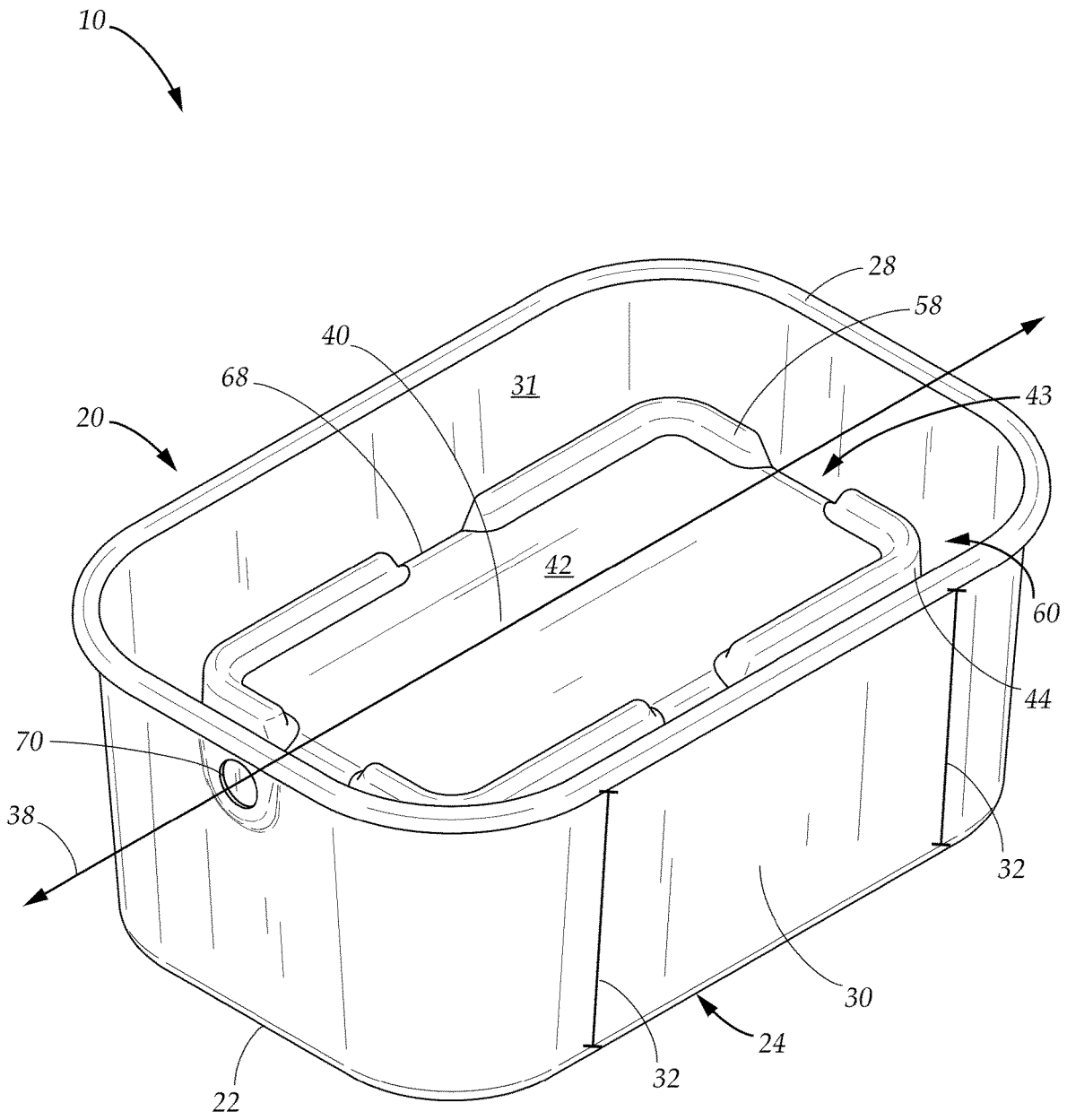
FIG. 1 is a perspective view of the condensate management apparatus having a modified pump collection tank, an elevated platform, a trough, and a drain outlet in accordance with some embodiments of the present disclosure.
Figure 2:
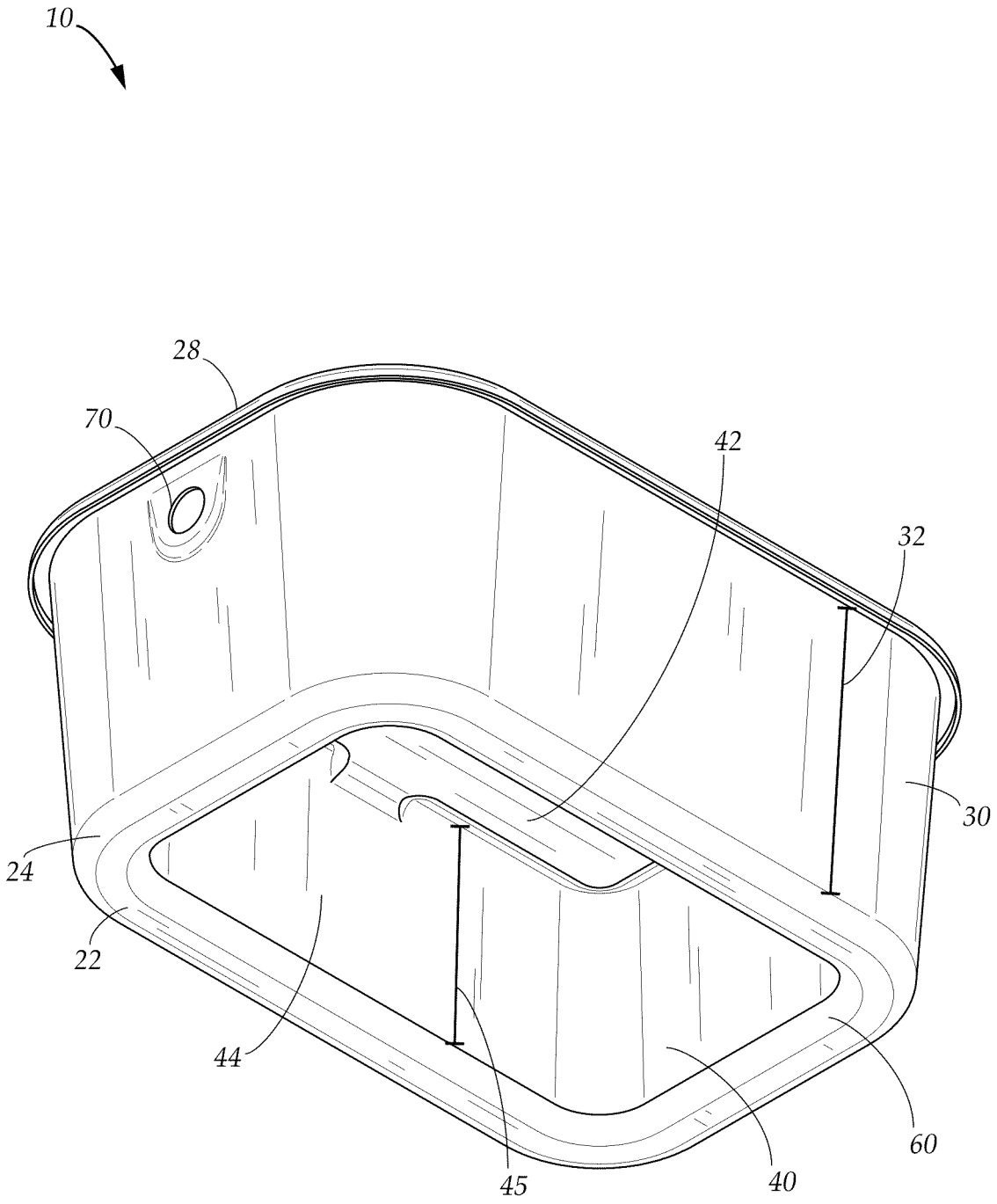
FIG. 2 is a bottom perspective view of the condensate management apparatus of FIG. 1.
Figure 3:
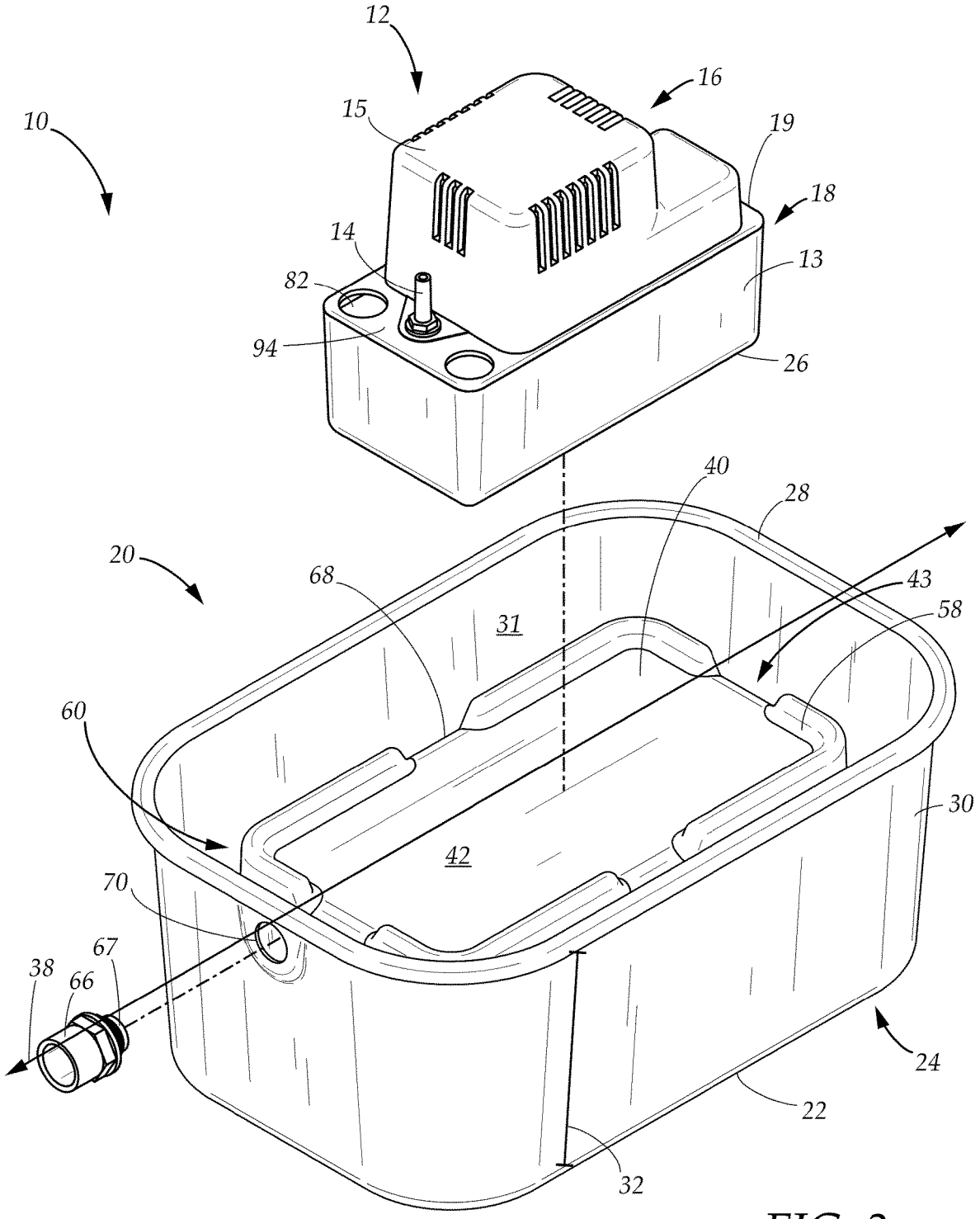
FIG. 3 is a perspective view of one embodiment of the condensate management apparatus configured for use in connection with a condensate pump assembly in accordance with some embodiments of the present disclosure.

Referring now to FIGS. 1, 2, and 3, a condensate management apparatus 10 is presented to manage liquid condensate from an HVAC system in the event of a condensate pump failure. In some embodiments, the condensate management apparatus 10 includes a modified pump collection tank 20 configured to collect the liquid condensate overflowing from a failed condensate pump. The modified pump collection tank 20 may include a substantially rigid, liquid-impermeable, heat-resistant material such as polycarbonate, plastic, metal, composite, and/or any other suitable material.

In some embodiments, the modified pump collection tank 20 includes a base 22, a top edge 28, and multiple outer walls 30 extending substantially perpendicularly between the base 22 and the top edge 28. The base 22 may be substantially planar and may include any rectangular, elliptical, circular, polygonal, or other suitable shape. In some embodiments, the top edge 28 is substantially congruent with the shape of the base 22 and elevated with respect to the base 22 by the height 32 of the outer wall 30. In other embodiments, the size and/or shape of the top edge 28 may vary with respect to the base 22. In certain embodiments, the top edge 28 may be rounded, contoured and/or may include a ledge or lip extending along at least a portion thereof.

In some embodiments, one or more of the outer walls 30 extend substantially perpendicularly between a periphery 24 of the base 22 and the top edge 28. The top edge 28 may thus be substantially aligned with the periphery 24 and may extend in a direction substantially parallel thereto. In other embodiments, one or more of the outer walls 30 vertically outwardly at an angle between the periphery 24 and the top edge 28. The top edge 28 may thus be offset with respect to the periphery 24, but still be circumferential with respect to the periphery 24.

In some embodiments, the modified pump collection tank 20 is monolithically formed as a single unit, such as by an injection-molding process or the like. In other embodiments, one or more of the outer walls 30 is coupled to the base 22 by welding, a press fit, and/or another suitable mechanical fastening technique. In other embodiments, one or more of the outer walls 30 is coupled to the base 22 by an adhesive or suitable bonding material. In still other embodiments, one or more of the outer walls 30 is coupled to the base 22 by one or more mechanical fastening devices such as rivets, grommets, screws, adhesives, and/or the like. In these and other embodiments, the outer walls 30 may be coupled to and/or sealed to the base 22 such that the modified pump collection tank 20 is configured to retain liquid therein.

In some embodiments, an elevated platform 40 is disposed within the modified pump collection tank 20 and extends substantially vertically from the base 22. In some embodiments, the elevated platform 40 includes a material having sufficient rigidity and strength to support a conventional condensate pump assembly 12. In certain embodiments, the elevated platform 40 is substantially centrally disposed relative to the base 22. The elevated platform 40 may include a support surface 42 disposed parallel to the base 22 and at least one sidewall 44 extending perpendicularly between the base 22 and the support surface 42. The support surface 42 is configured to receive and support the conventional condensate pump assembly 12 and may be substantially flat to support the conventional condensate pump assembly 12 flush thereon. The sidewall 44 may include a height 45 less than the height 32 of the outer walls 30.

In some embodiments, the elevated platform 40 includes dimensions at least slightly reduced relative to the dimensions of the modified pump collection tank 20 such that the elevated platform 40 is fully contained within the modified pump collection tank 20 and the support surface 42 is disposed below the top edge 28. The elevated platform 40 may thus form a trough 60 within the modified pump collection tank 20 between the sidewalls 44 and the inside surface 31 of the outer walls 30. In some embodiments, the trough 60 substantially surrounds the elevated platform 40.

In some embodiments, a raised barrier 58 extends along at least a portion of a perimeter 43 of the support surface 42. The raised barrier 58 may be rounded or otherwise contoured, and/or may include a ledge or lip configured to center the conventional condensate pump assembly 12 relative to the support surface 42. In some embodiments, the raised barrier 58 is configured to prevent the conventional condensate pump assembly 12 from inadvertently falling, floating, or slipping off the support surface 42 in the event the liquid condensate raises the conventional condensate pump assembly 12 from the support surface 42 such that the conventional condensate pump assembly 12 floats with respect thereto. In some embodiments, the raised barrier 58 includes a height between about one-quarter inch (¼ in.) and one and a half inches (1.5 in.). In other embodiments, the raised barrier 58 is configured to retain the conventional condensate pump assembly 12 in another suitable position relative to the support surface 42.

In certain embodiments, one or more gaps 68 separates adjacent portions of the raised barrier 58 along the perimeter 43. In some embodiments, the gaps 68 are configured to prevent liquid condensate from pooling onto the support surface 42 by directing the liquid condensate into the trough 60. In some embodiments, one or more of the gaps 68 may correspond to each of the sidewalls 44 of the elevated platform 40. In certain embodiments, each gap 68 may have a length between about one inch (1 in.) and about two inches (2 in.).

Figure 4:
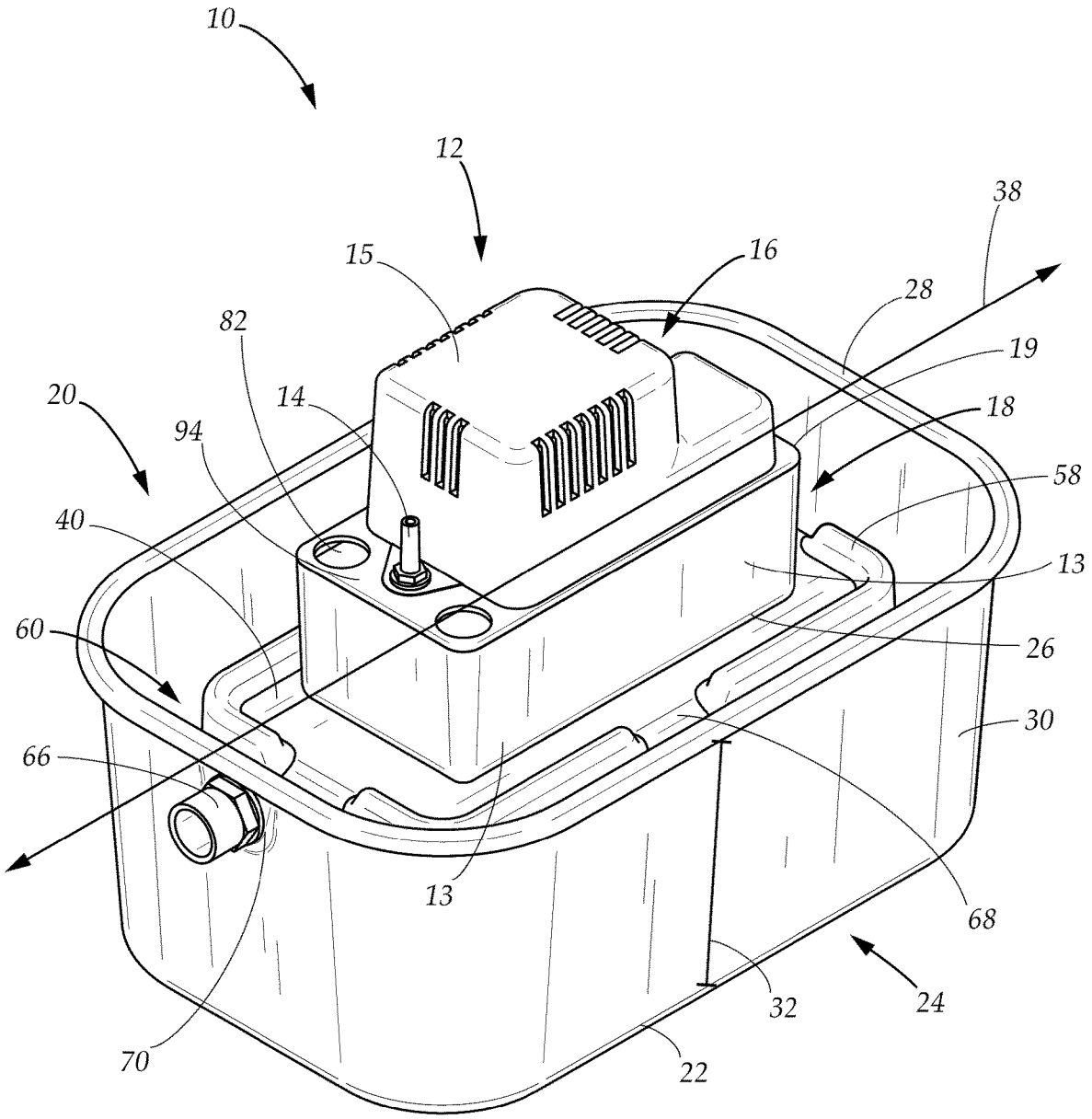
FIG. 4 is a perspective view of the condensate management apparatus and condensate pump assembly of FIG. 3 assembled for use in accordance with some embodiments of the present disclosure.
Figure 5:
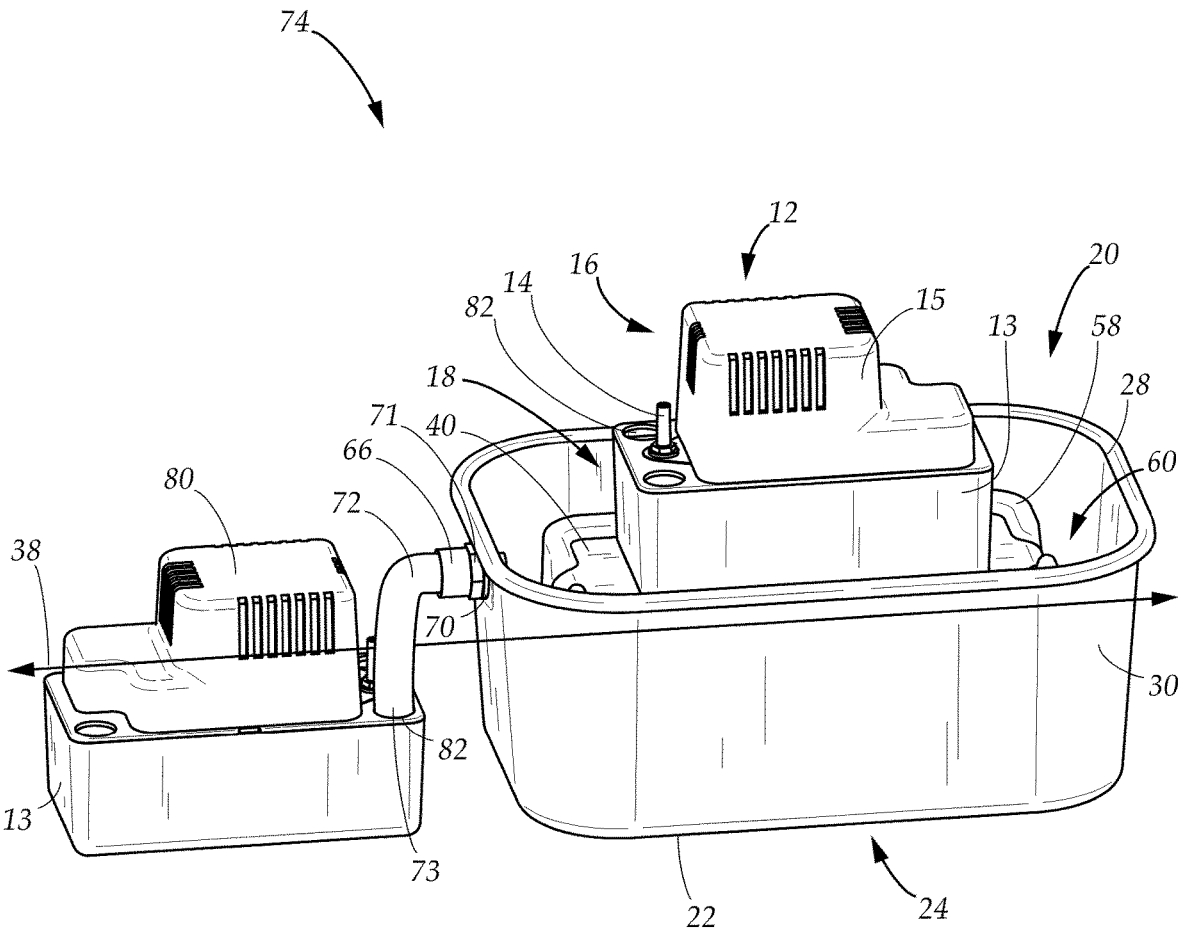
FIG. 5 is a perspective view of one embodiment of a condensate management apparatus and a conventional condensate pump assembly configured to direct an overflow of liquid condensate to an auxiliary condensate pump assembly in accordance with some embodiments of the present disclosure.

Referring now to FIGS. 3, 4, and 5, in certain embodiments, the support surface 42 is configured to support a conventional condensate pump assembly 12 of an HVAC system such that at least a portion of the conventional condensate pump assembly 12 is elevated above the top edge 28 of the modified pump collection tank 20. The conventional condensate pump assembly 12 may include a planar base 26 having a shape and size such that the conventional condensate pump assembly 12 is configured to fit on top of the support surface 42. Thus, in certain embodiments, the dimensions of the support surface 42 of the elevated platform 40 may be at least slightly greater than the planar base 26. In this manner, the conventional condensate pump assembly 12 may be supported and elevated relative to the base 22 of the modified pump collection tank 20.

In the event the conventional condensate pump assembly 12 fails, liquid condensate may overflow the conventional condensate pump assembly 12 onto the support surface 42. The barrier 58 and gaps 68 along the perimeter 43 of the support surface 42 may cooperate to direct the overflow into the trough 60. A level of the liquid condensate within the trough 60 may be controlled by a drain outlet 70 or port integrated into at least one of the outer walls 30 of the modified pump collection tank 20.

In certain embodiments, the drain outlet 70 is configured to direct liquid condensate within the trough 60 of the modified pump collection tank 20 to another receptacle and/or auxiliary condensate pump assembly 80 (see FIG. 5). In some embodiments, the drain outlet 70 is coupled to or integrated into the outer wall 30 and is in fluid communication with the trough 60. For example, in some embodiments, the drain outlet 70 includes an aperture or channel integrated into the outer wall 30 and disposed proximate to the top edge 28. In some embodiments, the lowest perimeter edge or lowest part of the drain outlet 70 is substantially aligned and/or co-planar with the support surface 42 of the elevated platform 40. In some embodiments, the drain outlet 70 is substantially centered with respect to the outer wall 30. The drain outlet 70 may be substantially circular, square, rectangular, elliptical, or may include any suitable regular or irregular shape.

In certain embodiments, a port connector 66 is configured to removably couple the modified pump collection tank 20 to a channel 72 via the drain outlet 70. Thus, in certain embodiments, the port connector 66 includes a size and shape configured to selectively engage the drain outlet 70. In one embodiment, an end 67 of the port connector 66 is configured to extend through the drain outlet 70. The end 67 of the port connector 66 may be configured to form a connection with the drain outlet 70 on the interior surface 31 of the outer wall 30. For example, in some embodiments, the end 67 of the port connector 66 includes threads configured to engage corresponding threads of the drain outlet 70 or another securing element to secure the channel 72 to the outer wall 30. In other embodiments, the port connector 66 extends from or is otherwise integrated with the drain outlet 70 to fixably couple the modified pump collection tank 20 to the channel 72.

Figure 6:
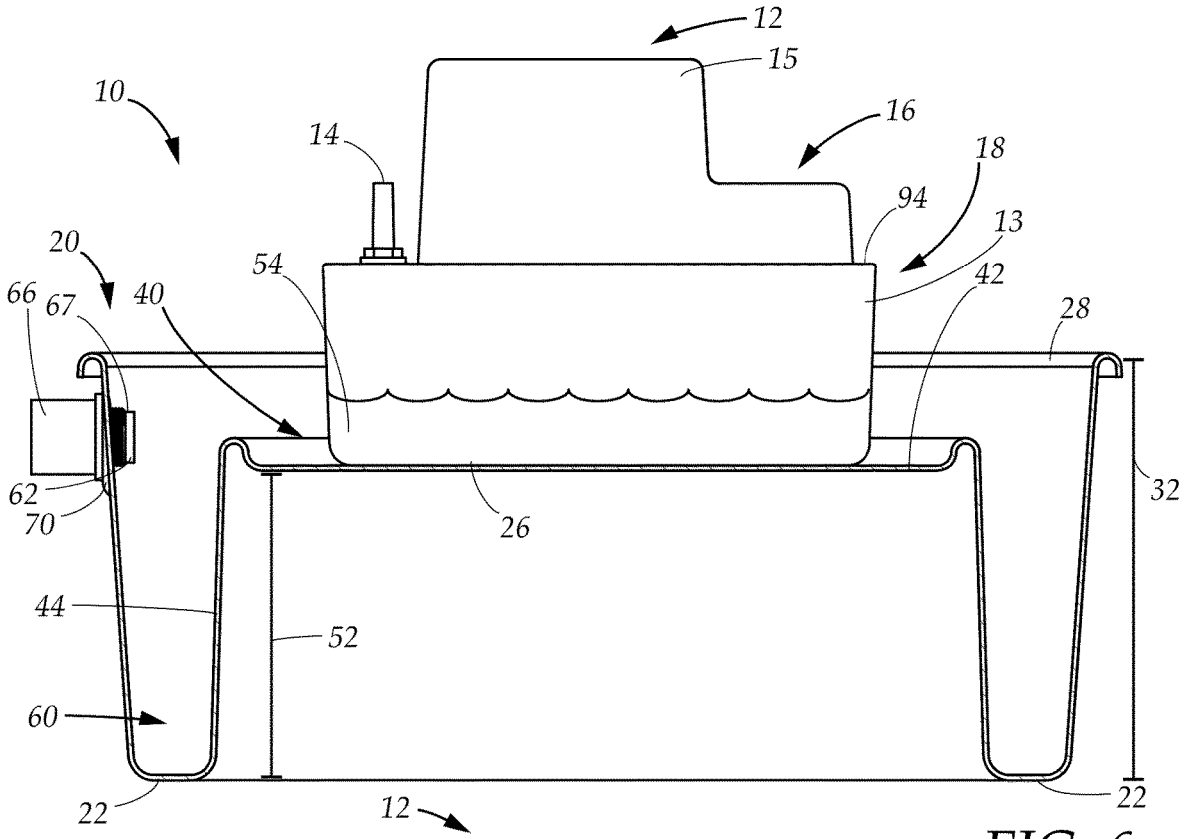
FIG. 6 is a cross-sectional view of an embodiment of a condensate management apparatus and a conventional condensate pump assembly in accordance with certain embodiments of the present disclosure.
Figure 7:
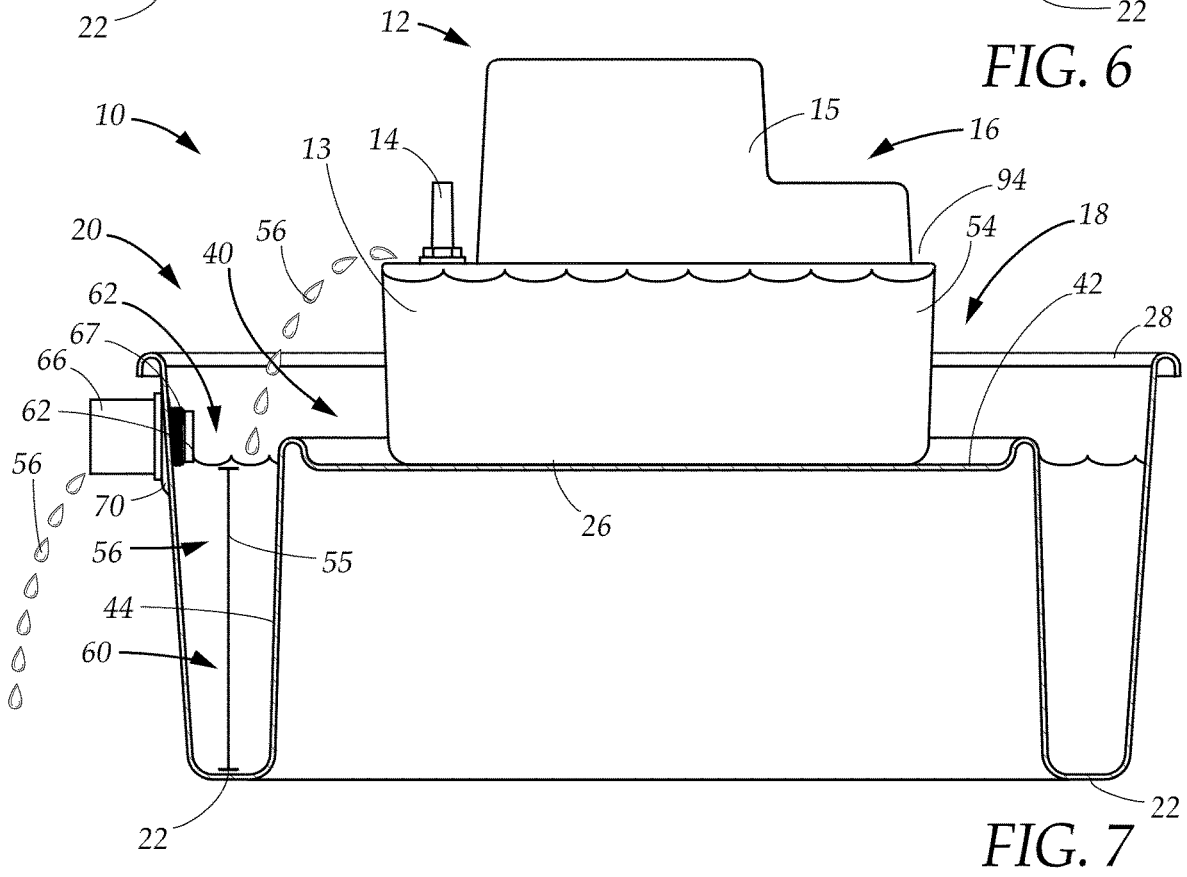
FIG. 7 is a cross-sectional view of the condensate management apparatus of FIG. 6 illustrating operation of the condensate management apparatus in accordance with various embodiments of the present disclosure.
Figure 8:
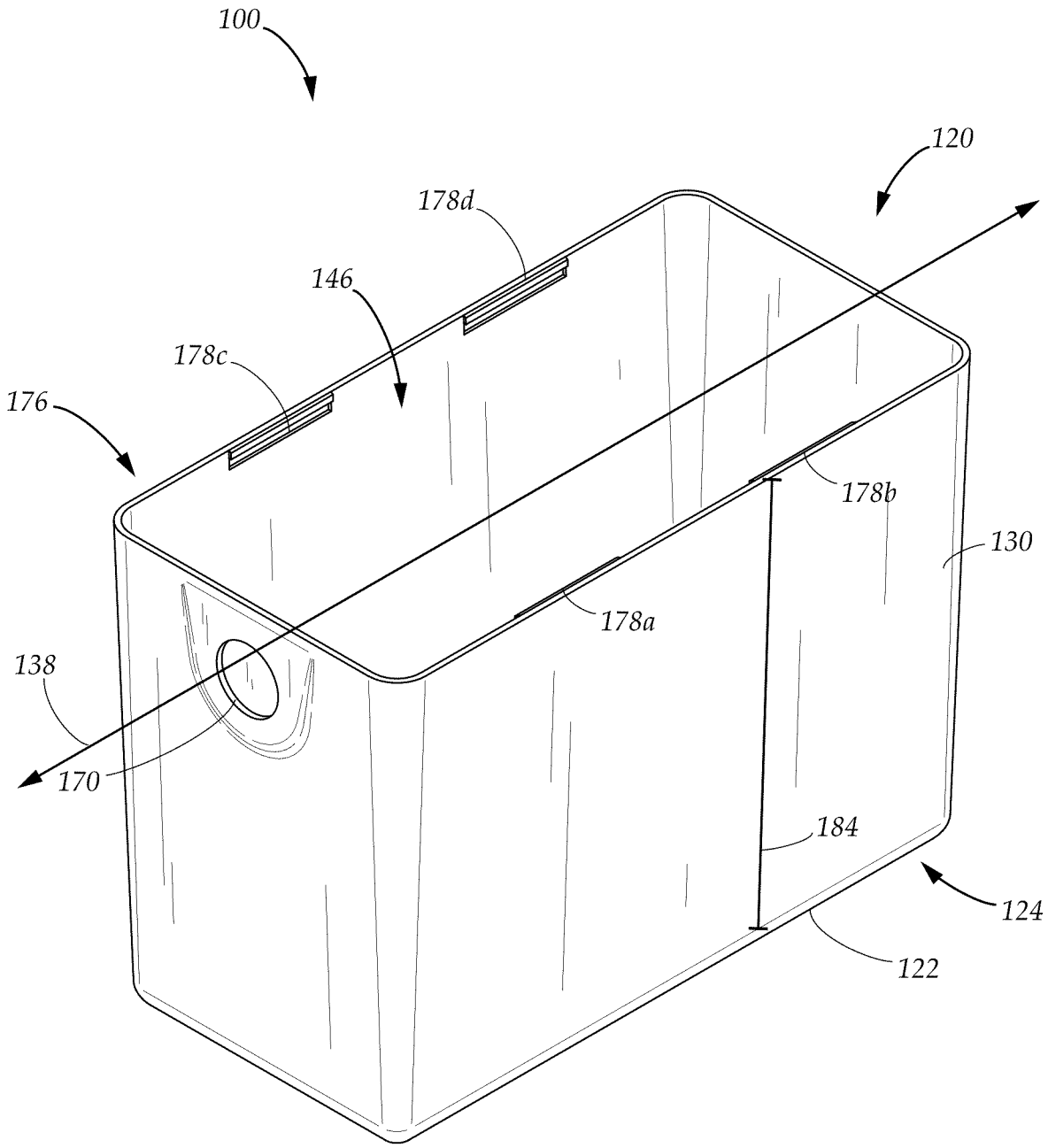
FIG. 8 is a perspective view of one embodiment of a modified pump collection tank of a condensate management apparatus including an outer wall having an optimized height and drain outlet in accordance with some embodiments of the present disclosure.
Figure 9:
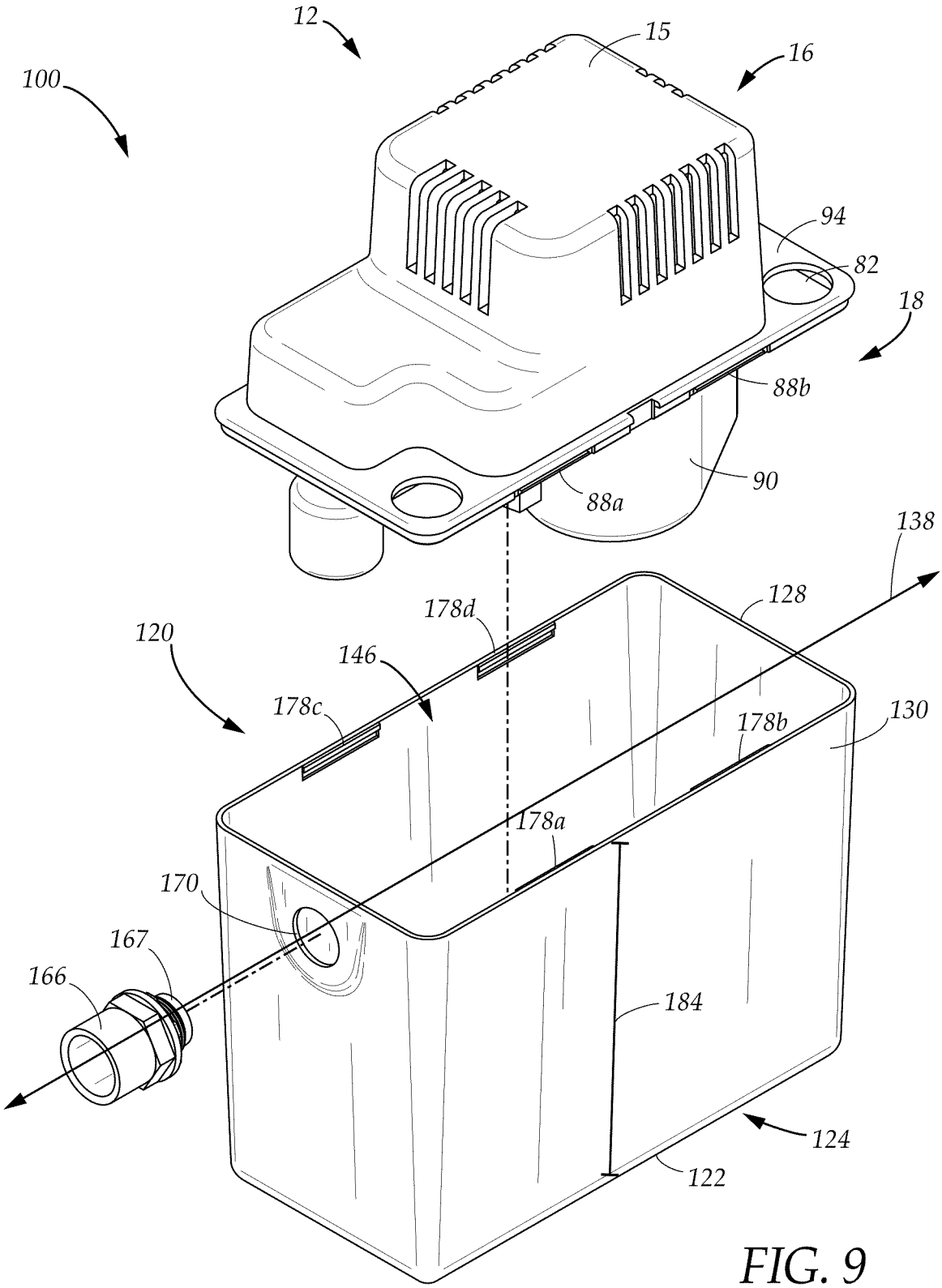
FIG. 9 is an exploded perspective view of one embodiment of the condensate management apparatus including a conventional condensate pump assembly retrofit with the modified pump collection tank of FIG. 8 in accordance with some embodiments of the present disclosure.
Figure 10:
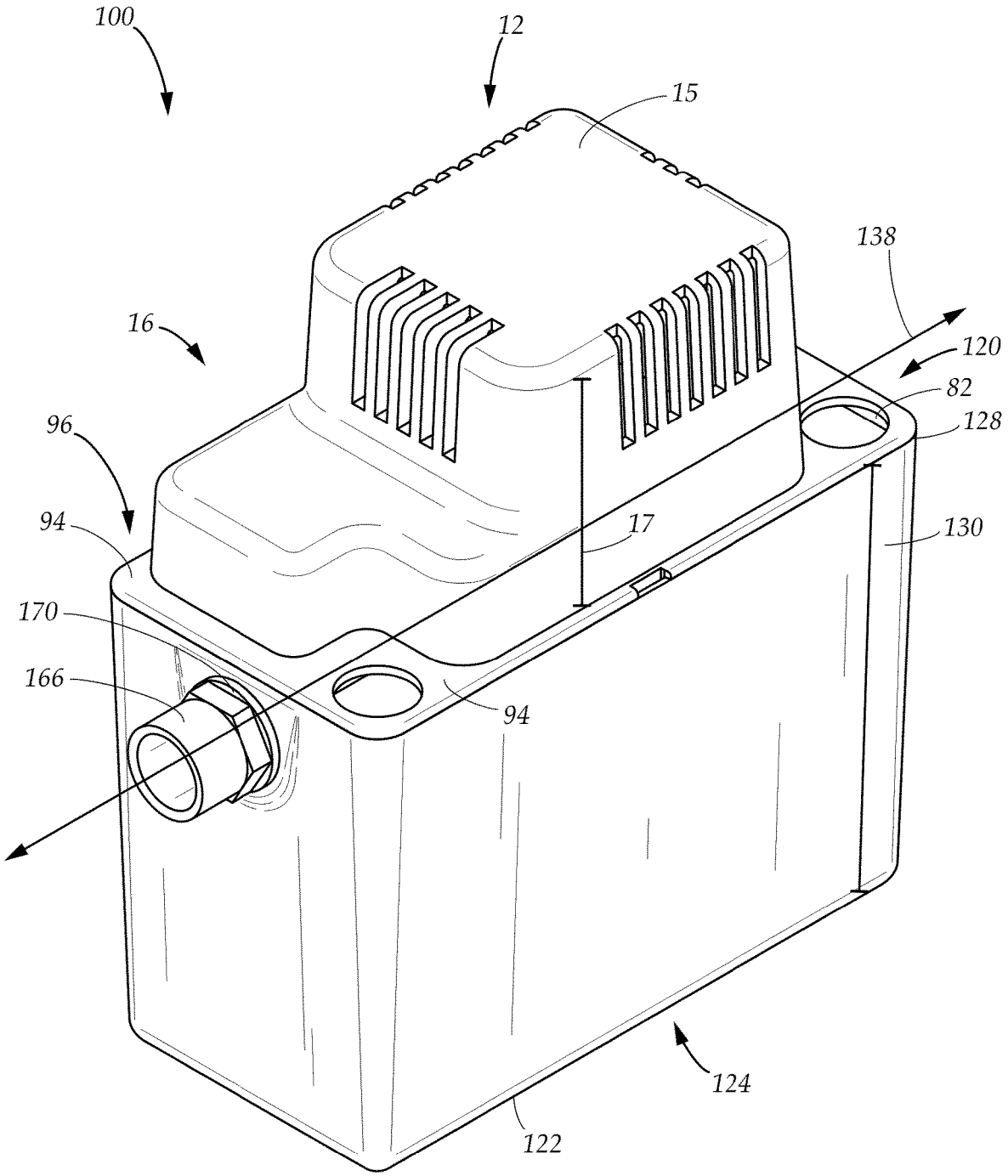
FIG. 10 is a perspective view of one embodiment of the condensate management apparatus of FIG. 9 having an optimized height in accordance with some embodiments of the present disclosure.

Referring now to FIGS. 6 and 7, while still referring to FIG. 5, in some embodiments, the channel 72 is disposed between the modified pump collection tank 20 and an auxiliary condensate pump assembly 80. In certain embodiments, the modified pump collection tank 20 and the auxiliary condensate pump assembly 80 are substantially aligned along the longitudinal axis 38. The conventional condensate pump assembly 12 may be disposed at a level higher than the auxiliary condensate pump assembly 80 by virtue of being supported by the elevated platform 40 within the modified pump collection tank 20.

The channel 72 may extend longitudinally between a first end 71 coupled to the port connector 66 and a second end 73 coupled to an inlet port 82 of the auxiliary condensate pump assembly 80. The channel 72 may include any suitable cross-sectional shape and may be hollow to enable a flow of liquid condensate therethrough. In some embodiments, the channel 72 is substantially cylindrical.

In some embodiments, the channel 72 extends substantially vertically from the drain outlet 70 of the modified pump collection tank 20 to the inlet port 82 of the auxiliary condensate pump assembly 80. In this manner, in some embodiments, the channel 72 facilitates a flow of the liquid condensate from the modified pump collection tank 20 to the auxiliary condensate pump assembly 80 via gravity.

The first end 71 of the channel 72 may selectively engage the port connector 66 and the second end 73 may selectively engage the inlet port 82 of the auxiliary condensate pump assembly 80. In some embodiments, the second end 73 engages the inlet port 82 via any suitable mechanical device or mechanism such as a press fit, a threaded connection, an adhesive, a clamp, and/or the like. In one embodiment, the second end 73 of the channel 72 is received into the inlet port 82 without being physically connected thereto. In these and other embodiments, an overflow of liquid condensate may be directed through the channel 72 in a direction from the modified pump collection tank 20 to the inlet port 82. In certain embodiments, the auxiliary condensate pump assembly 80 may thus receive and process the overflow of liquid condensate to compensate for the failed conventional condensate pump assembly 12.

In some embodiments, a pump assembly 12, 80 such as the conventional condensate pump assembly 12 and/or the auxiliary condensate pump assembly 80, may be configured to collect and dispose of liquid condensate generated from an HVAC system. In some embodiments, includes an upper portion 16, a lower portion 18, and a horizontal plate 94 configured to cover the lower portion 18. In some embodiments, the lower portion 18 includes a substantially planar base 26 having a rectangular, circular, elliptical, polygonal, or other suitable shape.

In some embodiments, the upper portion 16 is disposed above the lower portion 18 such that the lower portion 18 collects the liquid condensate 54 via gravity. In some embodiments, the lower portion 18 includes a receptacle 13 extending in a downward direction relative to the horizontal plate 94. Similarly, the upper portion 16 may include a housing 15 extending in an upward direction relative to the horizontal plate 94. In certain embodiments, a hose connector 14 extends from the horizontal plate 94 and is configured to attach to a hose or other component of the HVAC system to transport liquid condensate away from the pump assembly 12, 80.

In some embodiments, the receptacle 13 is removably attached to the housing 15 via one or more mechanical features. In some embodiments, for example, the horizontal plate 94 includes one or more projections, flanges, or other features configured to engage and interlock with corresponding apertures or features integrated into the receptacle 13. In other embodiments, the horizontal plate 94 and the receptacle 13 may be integrally formed or may be coupled together via any other suitable mechanical attachment mechanism or device.

In some embodiments, the horizontal plate 94 includes one or more inlet ports 82 in fluid communication with the receptacle 13 such that liquid condensate may be received into the receptacle 13 via the inlet port 82. The inlet ports 82 may form openings through the horizontal plate 94. In some embodiments, the inlet port 82 may be circular in shape, or may include any suitable regular or irregular shape. In certain embodiments, the inlet port 82 includes a size and/or shape configured to receive the second end 73 of the channel 72. In some embodiments, only one of the inlet ports 82 is open for liquid condensate collection while the remaining inlet ports 82 are closed via removable plugs or the like.

In operation, the liquid condensate 54 may be received by the receptacle 13 of the conventional condensate pump assembly 12. In some embodiments, the conventional condensate pump assembly 12 is automatically or manually actuated to remove the liquid condensate 54 through a hose or other device coupled to the hose connector 14. In the event the conventional condensate pump assembly 12 fails, however, an overflow 56 of the liquid condensate 54 may empty onto the support surface 42 and/or into the trough 60 of the modified pump collection tank 20. In some embodiments, the overflow 56 rises within the trough 60 to a predetermined threshold level 62. In some embodiments, the predetermined threshold level 62 is equivalent to a height 55 of the drain outlet 70. In the event a volume of the overflow 56 exceeds the predetermined threshold level 62, at least a portion of the overflow 56 may exit the modified pump collection tank 20 through the drain outlet 70 to the auxiliary condensate pump assembly 80. In certain embodiments, the portion of the overflow 56 flows into a port connector 66 and/or channel 72 coupled to the drain outlet 70, which in turn is coupled to the auxiliary condensate pump assembly 80.

Referring now to FIGS. 8, 9, 10, 12, and 13, according to another aspect of the present disclosure, in some embodiments, the condensate management apparatus 100 includes a conventional condensate pump assembly 12 with a modified pump collection tank 120. The modified pump collection tank 120 is configured to collect liquid condensate generated by an HVAC system. The modified pump collection tank 120 may include a base 122 having a periphery 124, a top edge 128, and multiple outer walls 130 extending substantially vertically between the periphery 124 and the top edge 128. In some embodiments, the modified pump collection tank 120 defines a first compartment 146.

In some embodiments, at least a portion of the conventional condensate pump assembly 12 is disposed within the first compartment 146. The conventional condensate pump assembly 12 and the first compartment 146 may extend along a longitudinal axis 138 when the condensate management apparatus 100 is assembled. In some embodiments, at least a portion of the conventional condensate pump assembly 12 may be situated above the first compartment 146. The conventional condensate pump assembly 12 may include an upper portion 16 and a lower portion 18. In some embodiments, the lower portion 18 is disposed within the first compartment 146. A horizontal plate 94 may project outwardly along a periphery of the upper portion 16 such that the horizontal plate 94 is interposed between the upper portion 16 and the lower portion 18.

In some embodiments, the horizontal plate 94 includes a shape and/or dimensions configured to substantially correspond to and/or cover the top edge 128 of the modified pump collection tank 120. In certain embodiments, the horizontal plate 94 may include a ledge or lip configured to removably engage the top edge 128 in a press fit. In other embodiments, the horizontal plate 94 is configured to mount to the top edge 128 via one or more suitable mechanical fastening devices or techniques such as a clip, a rivet, a grommet, a screw, an adhesive, a bonding material, welding, and/or the like.

In one embodiment, a perimeter edge 96 of the horizontal plate 94 includes one or more pairs of mounting flanges 88*a*, 88*b* configured to releasably engage the modified pump collection tank 120 via corresponding attachment elements 178*a-d* coupled to or integrated at or near the top edge 128. The attachment elements 178*a-d* may include, for example, recesses, grooves, apertures, clips, and/or any other suitable corresponding features. In other embodiments, the horizontal plate 94 is integrated with the top edge 128 of the modified pump collection tank 120.

In some embodiments, the horizontal plate 94 is coupled to the top edge 128 of the modified pump collection tank 120 such that the upper portion 16 of the conventional condensate pump assembly 12 is suspended above the modified pump collection tank 120 while the lower portion 18 is disposed within a volume of the modified pump collection tank 120. In some embodiments, the lower portion 18 may include various components of the conventional condensate pump assembly 12 such as a centrifugal pump 190, a float 186, and/or an alarm 164.

In some embodiments, one or more of the outer walls 130 includes an optimized height 184. In some embodiments, the optimized height 184 may be one and half to three times the height 17 of the upper portion 16. In other embodiments, the optimized height 184 may be between about 7.0 inches and about 7.5 inches.

In these and other embodiments, the conventional condensate pump assembly 12 may include a modified float assembly 165 including a modified float 186 coupled to an alarm 164. In certain embodiments, the modified float 186 includes a foamed thermoplastic or other suitable material configured to float at or near a surface of liquid condensate within the modified pump collection tank 120. The modified float 186 may be configured to provide a liquid level control.

In these and other embodiments, the modified float 186 may pivot vertically to actuate an electric motor (not shown) to release the liquid condensate 154 from the modified pump collection tank 120. In some embodiments, the modified float 186 is mechanically coupled to the alarm 164 such that the alarm 164 is triggered by the float 186 pivoting or moving above a predetermined threshold level 163. In certain embodiments, the alarm 164 is triggered in response to actuation of the electric motor (not shown).

In some embodiments, the float assembly 165 includes a sensor 161 in electronic communication with the alarm 164. The sensor 161 may include a motion sensor, a moisture sensor, an optical sensor, and/or any other suitable sensor. In some embodiments, the sensor 161 is configured to activate the alarm 164 in response to the liquid condensate 154 reaching the predetermined threshold level 163. The alarm 164 may include an audible alarm, an electronic notification, and/or a telephone call to a user or owner. In certain embodiments, the electric motor (not shown) and/or the alarm 164 may be automatically deactivated in response to the level of liquid condensate 154 within the modified pump collection tank 120 dropping below the predetermined level 163.

In some embodiments, the modified float 186 is coupled to a modified shaft 185 extending from the horizontal plate 94. The shaft 185 may include an optimized length 187 to accommodate the optimized height 184 of the modified pump collection tank 120. The optimized length 187 may enable the modified float 164 to float atop or along the liquid condensate 154 at a level at or near the base 122 of the modified pump collection tank 120. In some embodiments, the optimized length 187 may substantially correspond to the optimized height 184. In other embodiments, the optimized length 187 may be less than the optimized height 184.

In some embodiments, the optimized height 184 increases the volume of liquid condensate 154 that the condensate management apparatus 100 may contain. In the event of a failure of the conventional condensate pump assembly 12, however, the optimized length 187 of the modified float 186 may be configured to activate the associated alarm 164 when the liquid condensate 154 level is still low within the modified pump collection tank 120. In this manner, various embodiments maximize the amount of time that a user has to respond to an alert that the failed conventional condensate pump assembly 12 has failed, thereby increasing a likelihood that the user will be able to address the issue before damage results.

Figure 11:
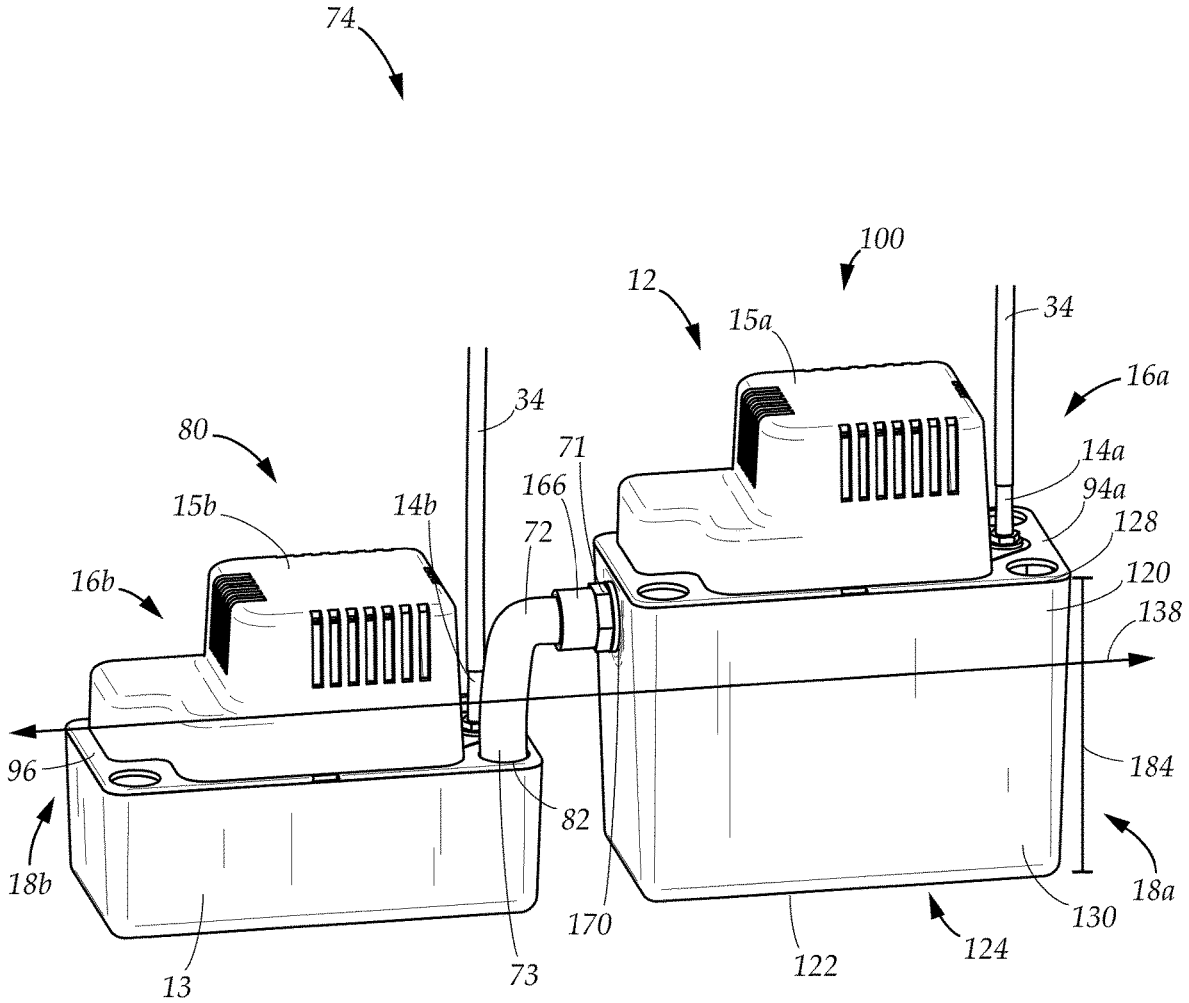
FIG. 11 is a side perspective view of one embodiment of a condensate management system including the condensate management apparatus of FIG. 9 connected to an auxiliary condensate pump assembly, in which the condensate management system is configured to direct an overflow of liquid condensate from the condensate management apparatus to the auxiliary condensate pump assembly in accordance with certain embodiments of the present disclosure.
Figure 13:
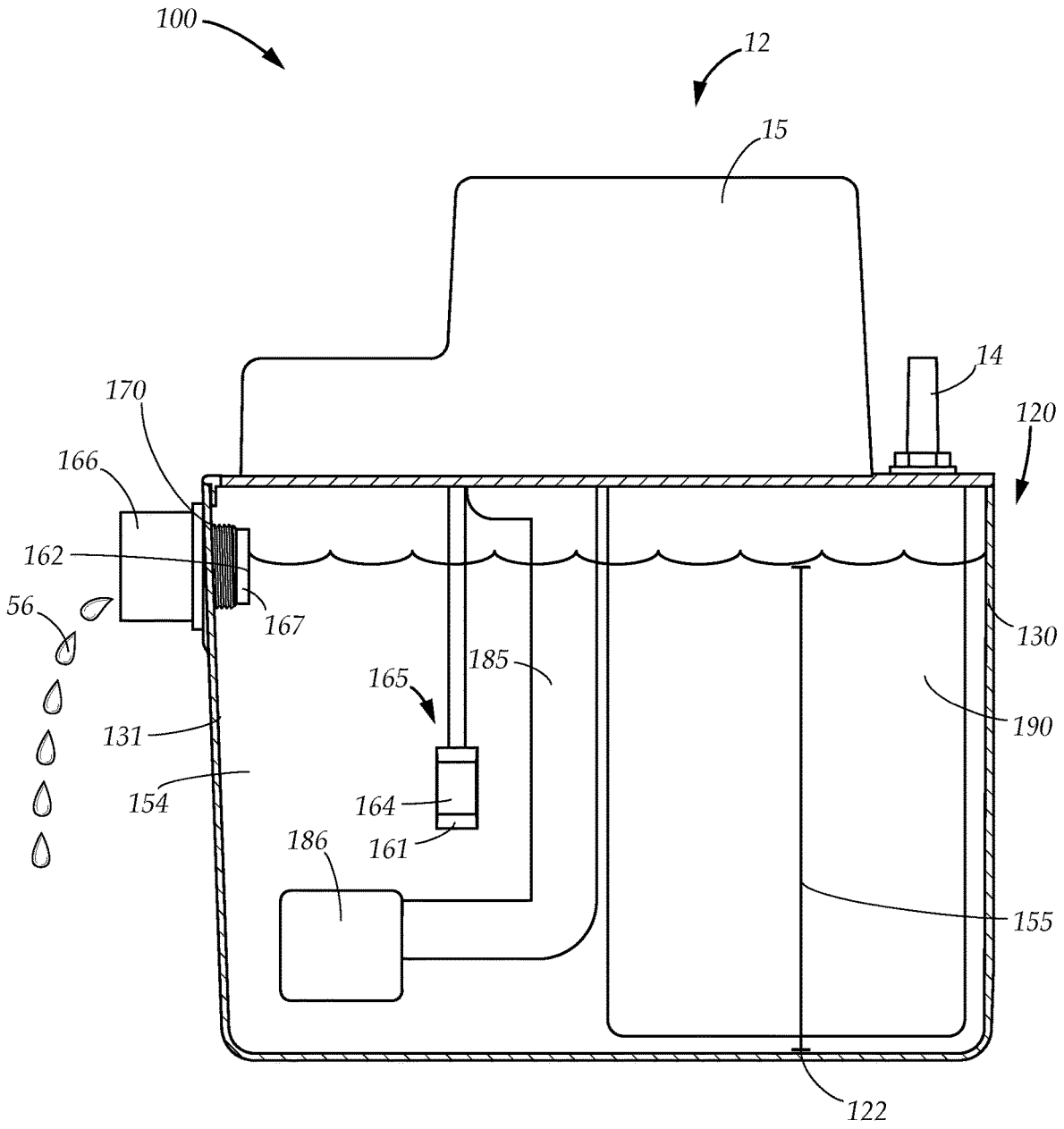
FIG. 13 is a side cross-sectional view of the condensate management apparatus of FIG. 12 in operation in accordance with some embodiments of the present disclosure.

Referring now to FIGS. 11 and 13, in some embodiments, a condensate management system 74 includes an auxiliary condensate pump assembly 80 configured to receive an overflow 56 of liquid condensate 154 from the condensate management apparatus 100. In certain embodiments, the auxiliary condensate pump assembly 80 and the condensate management apparatus 100 are aligned along the longitudinal axis 138.

A level of the liquid condensate 154 within the modified pump collection tank 120 may be controlled by a drain outlet 170 or port integrated into at least one of the outer walls 130. The optimized height 184 of the outer walls 130 enables the drain outlet 170 to be disposed at a level higher than a level of an auxiliary pump assembly 80. In this manner, the drain outlet 170 may utilize gravity to direct liquid condensate 154 within the modified pump collection tank 120 to the auxiliary condensate pump assembly 80. In some embodiments, the drain outlet 170 is coupled to or integrated into the outer wall 130 of the modified pump collection tank 120. For example, in some embodiments, the drain outlet 170 includes an aperture or channel integrated into the outer wall 130 and disposed proximate to the top edge 128. The drain outlet 170 may be substantially circular, square, rectangular, elliptical, or may include any suitable regular or irregular shape. In some embodiments, the drain outlet 170 is substantially aligned with the longitudinal axis 138 and disposed adjacent to the top edge 128 of the modified pump collection tank 120.

In certain embodiments, a port connector 166 is configured to removably couple the modified pump collection tank 120 to a channel 72 via the drain outlet 170. Thus, in certain embodiments, the port connector 166 includes a size and shape configured to selectively engage the drain outlet 170. In one embodiment, an end 167 of the port connector 166 is configured to extend through the drain outlet 170. The end 167 of the port connector 166 may be configured to be secured to the drain outlet 170 on the interior surface 131 of the outer wall 130. For example, in some embodiments, the end 167 of the port connector 166 includes threads configured to engage corresponding threads of the drain outlet 170 or a securing element configured to secure the channel 72 to the outer wall 130. In other embodiments, the port connector 166 extends from or is otherwise integrated with the drain outlet 170 to fixably couple the modified pump collection tank 120 to the channel 72.

in some embodiments, the channel 72 is disposed between the modified pump collection tank 120 and the auxiliary condensate pump assembly 80. In certain embodiments, the modified pump collection tank 120 and the auxiliary condensate pump assembly 80 are substantially aligned along the longitudinal axis 138. The conventional condensate pump assembly 12 may be disposed at a level higher than the auxiliary condensate pump assembly 80 by virtue of the optimized height 184 of the modified pump collection tank 120.

The channel 72 may extend longitudinally between a first end 71 coupled to the port connector 166 and a second end 73 coupled to an inlet port 82 of the auxiliary condensate pump assembly 80. The channel 72 may include any suitable cross-sectional shape and may be hollow to enable a flow of liquid condensate therethrough. In some embodiments, the channel 72 is substantially cylindrical.

In some embodiments, the channel 72 extends substantially vertically from the drain outlet 170 of the modified pump collection tank 120 to the inlet port 82 of the auxiliary condensate pump assembly 80. In this manner, in some embodiments, the channel 72 facilitates a flow of the liquid condensate 154 overflow 56 from the modified pump collection tank 120 to the auxiliary condensate pump assembly 80 via gravity.

The first end 71 of the channel 72 may selectively engage the port connector 166 and the second end 73 may selectively engage the inlet port 82 of the auxiliary condensate pump assembly 80. In some embodiments, the second end 73 engages the inlet port 82 via any suitable mechanical device or mechanism such as a press fit, a threaded connection, an adhesive, a clamp, and/or the like. In one embodiment, the second end 73 of the channel 72 is received into the inlet port 82 without being physically connected thereto. In these and other embodiments, the overflow 56 of liquid condensate 154 may be directed through the channel 72 in a direction from the modified pump collection tank 120 to the inlet port 82. In certain embodiments, the auxiliary condensate pump assembly 80 may thus receive and process the overflow 56 of liquid condensate 154 to compensate for the failed conventional condensate pump assembly 12.

Figure 12:
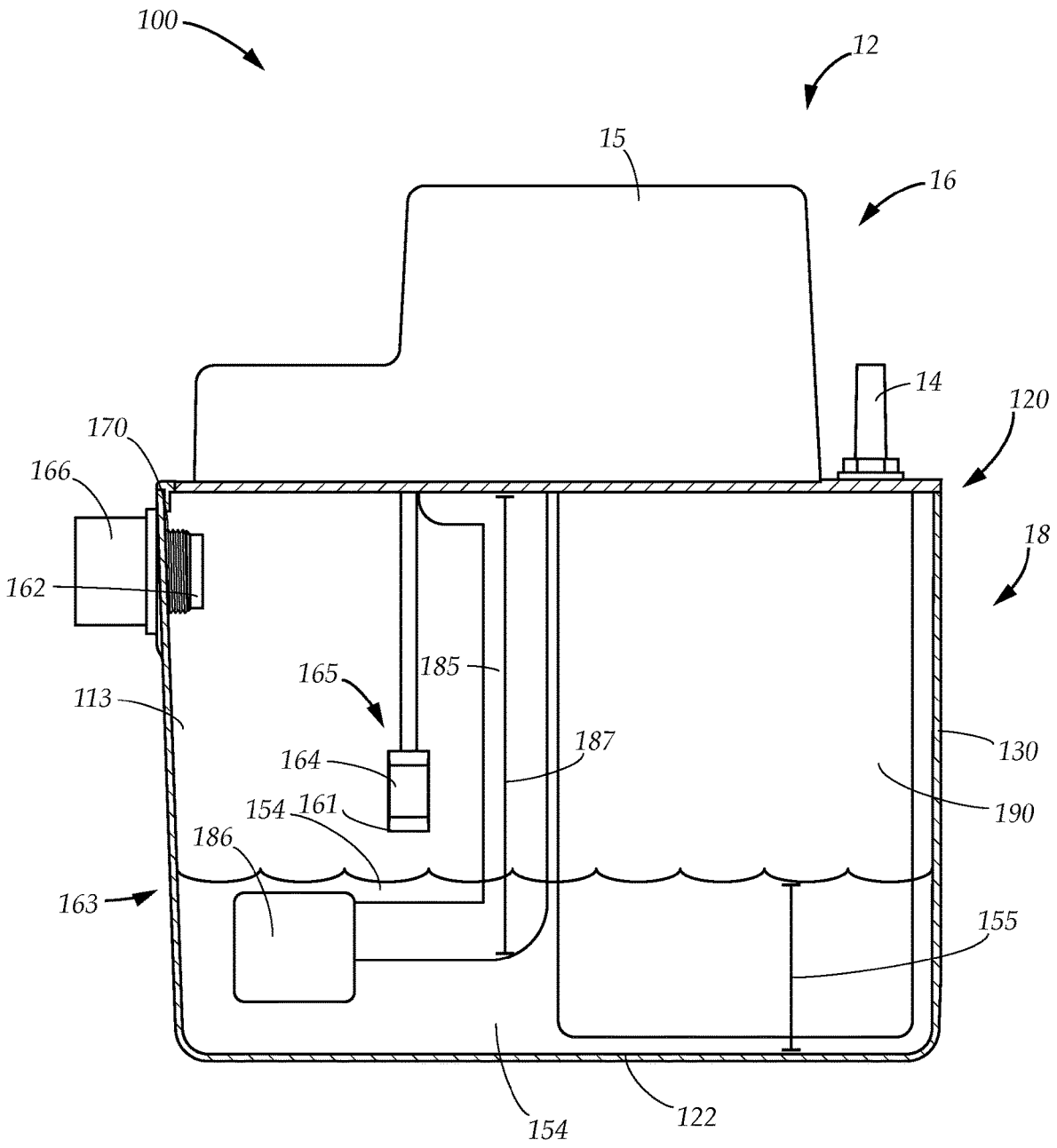
FIG. 12 is a side cross-sectional view of one embodiment of the condensate management apparatus of FIG. 10, illustrating the configuration of the internal components of the conventional condensate pump assembly with respect to the modified pump collection tank in accordance with some embodiments of the present disclosure.

Referring now to FIGS. 11, 12, and 13, various components of the conventional condensate pump assembly 12 and/or the auxiliary condensate pump assembly 80 may be included or contained within its lower portion 18*a*, 18*b* and/or upper portion 16*a*, 16*b*. For example, in certain embodiments, the upper portion 16*a*, 16*b* includes a housing 15*a*, 15*b* containing an electric motor (not shown). At least a portion of the electric motor (not shown) may extend downward through the horizontal plate 94*a*, 94*b* and attach to a centrifugal pump (not shown) disposed within the modified pump collection tank 120 or receptacle 13 of the lower portion 18*a*, 18*b*. In some embodiments, the electric motor (not shown) is responsive to the liquid level float assembly 165 to intermittently drive the centrifugal pump 190 to discharge the liquid condensate 154 from the modified pump collection tank 120 or receptacle 13.

The centrifugal pump 190 may be configured to pump liquid condensate 154 out of the modified pump collection tank 120 or receptacle 13. In some embodiments, the conventional condensate pump assembly 12 and/or the auxiliary condensate pump assembly 80 may be configured to discharge the liquid condensate 154 in an upward direction through a hose connector 14*a*, 14*b* extending through the horizontal plate 94*a*, 94*b*.

Figure 14:
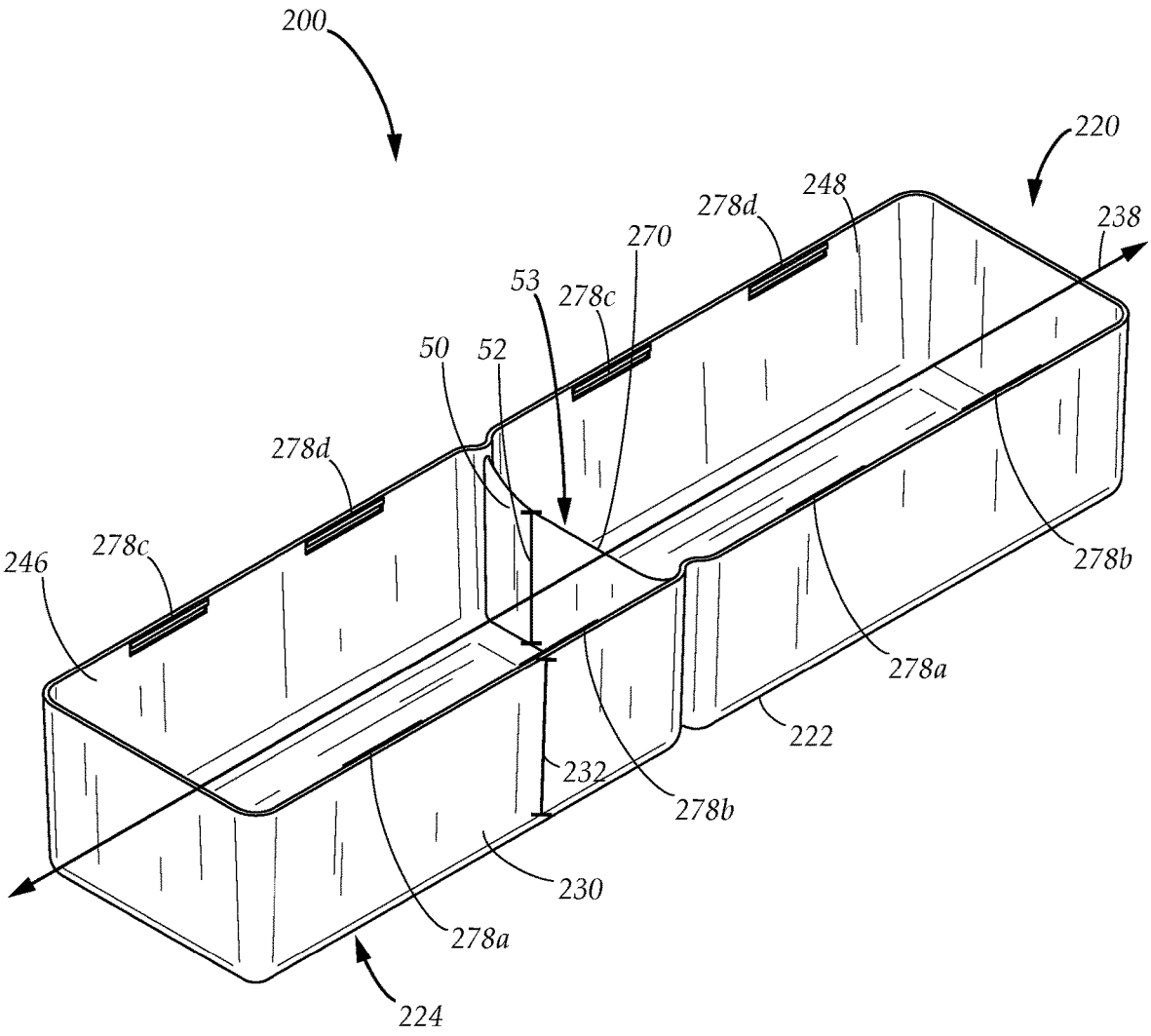
FIG. 14 is a perspective view of another embodiment of a condensate management system including a modified pump collection tank including a first compartment and a second compartment bifurcated by an overflow wall in accordance with some embodiments of the present disclosure.
Figure 15:
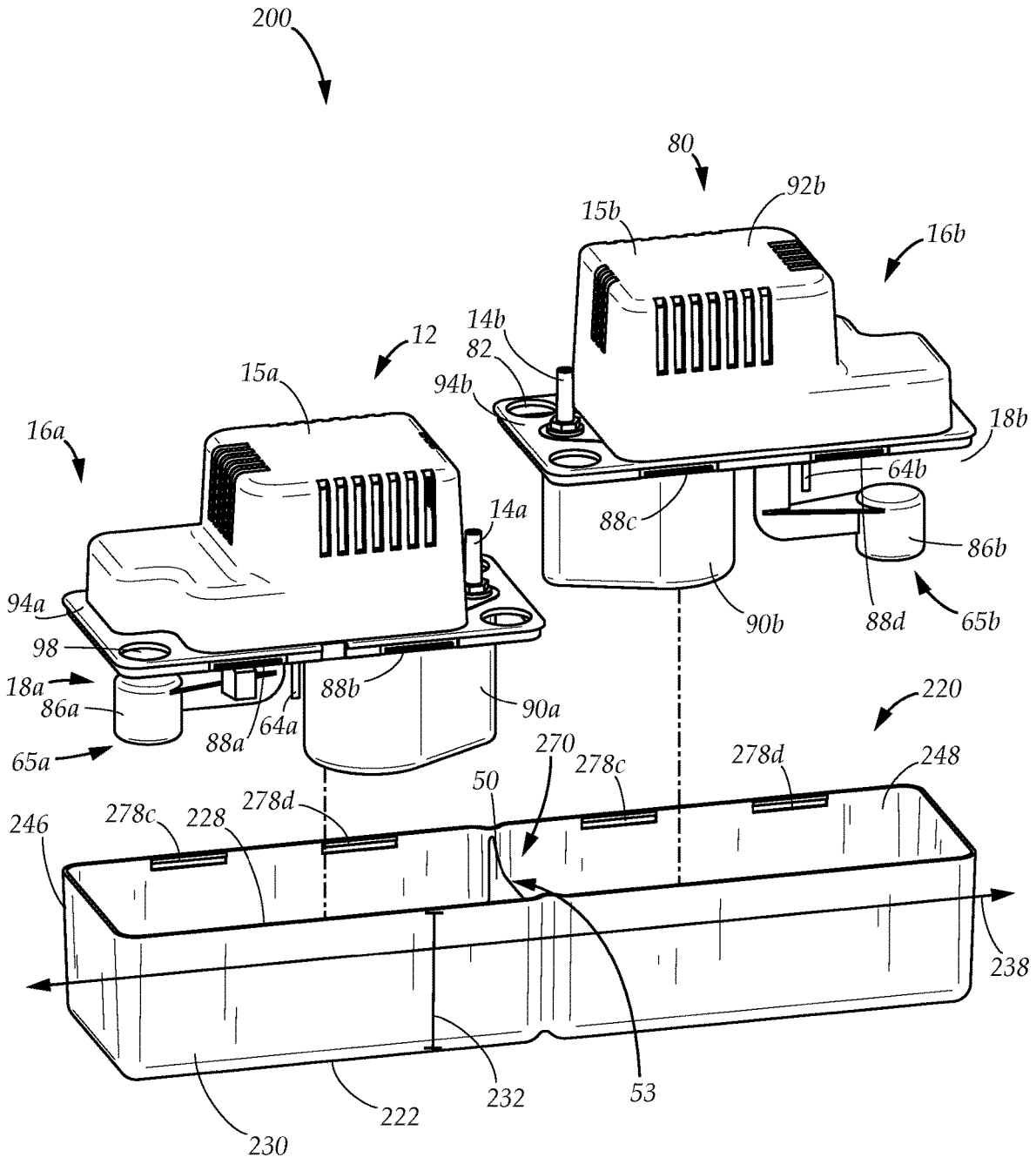
FIG. 15 is a perspective view of a condensate management system having a first compartment including a conventional condensate pump assembly and a second compartment including an auxiliary condensate pump assembly in accordance with certain embodiments of the present disclosure.
Figure 16:
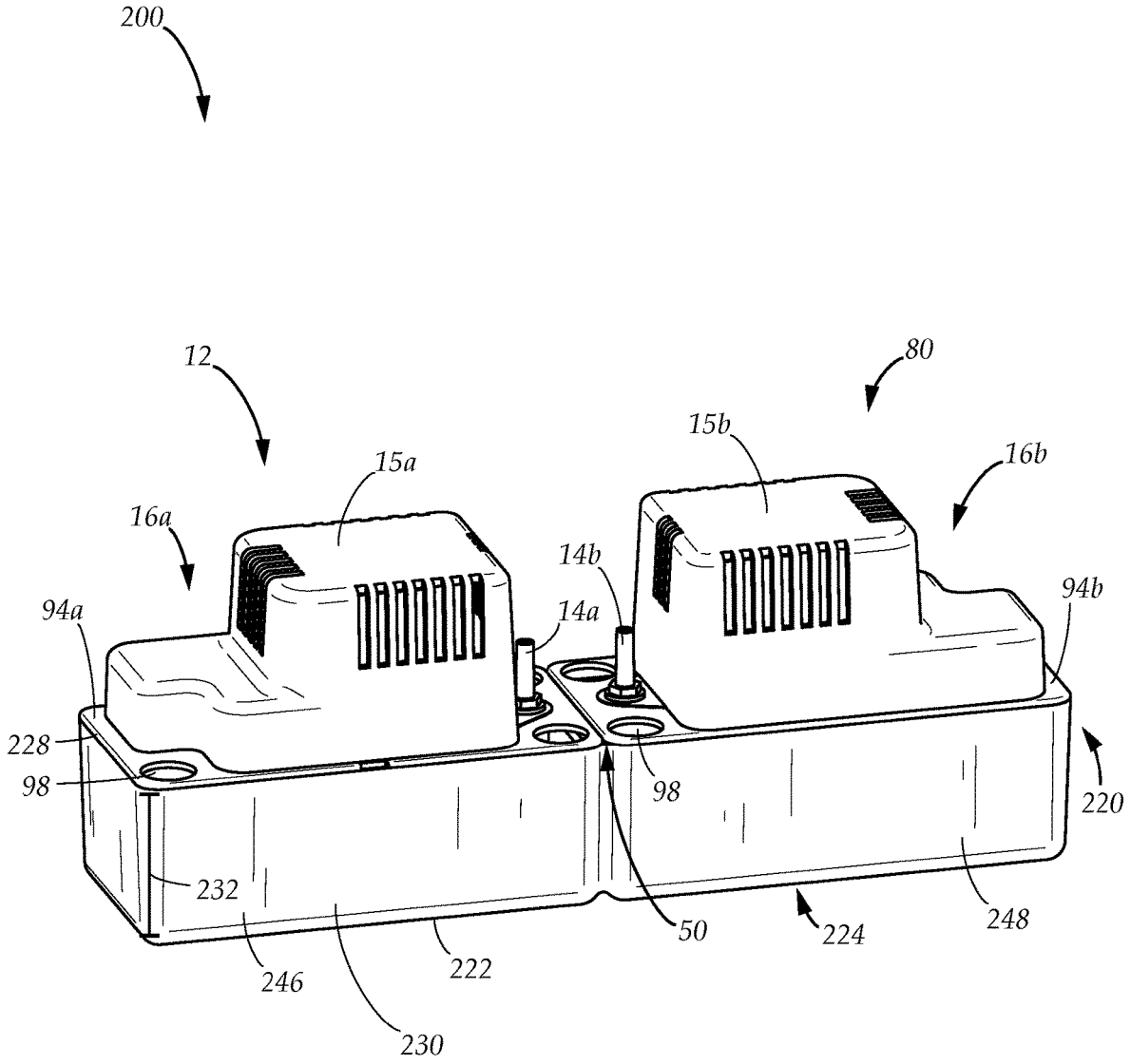
FIG. 16 is a perspective view of the condensate management system of FIG. 15 assembled in accordance with some embodiments of the present disclosure.
Figure 17:
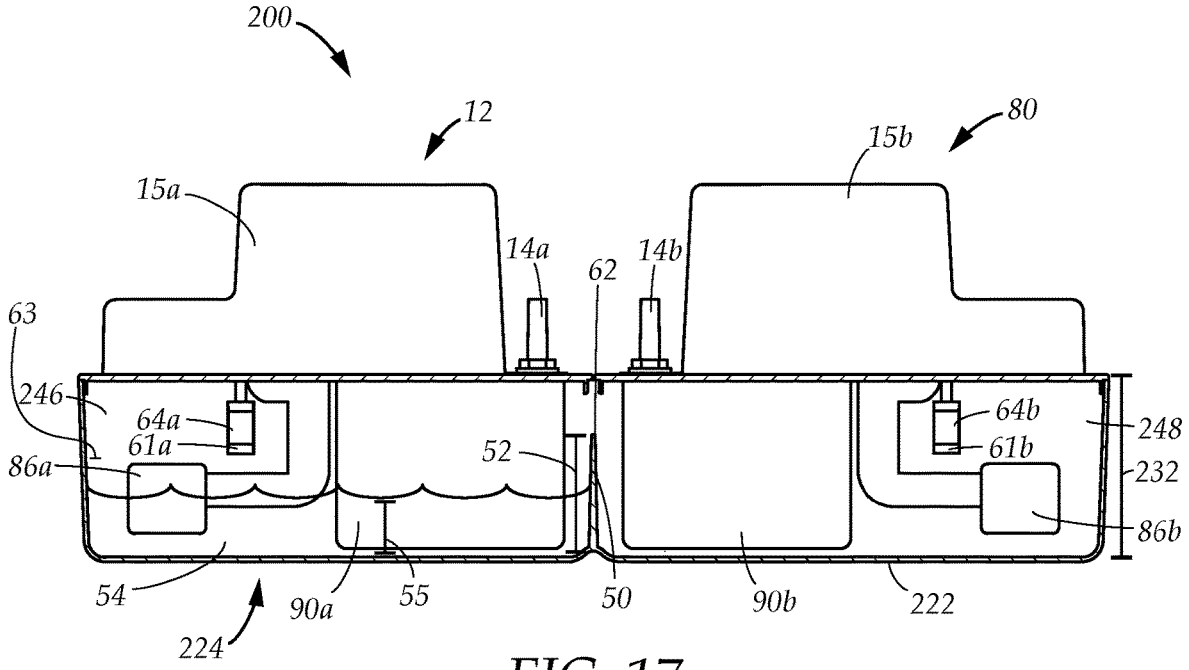
FIG. 17 is a side cross-sectional view of the condensate management system of FIG. 15 illustrating liquid condensate contained within the first compartment in accordance with some embodiments of the present disclosure.
Figure 18:
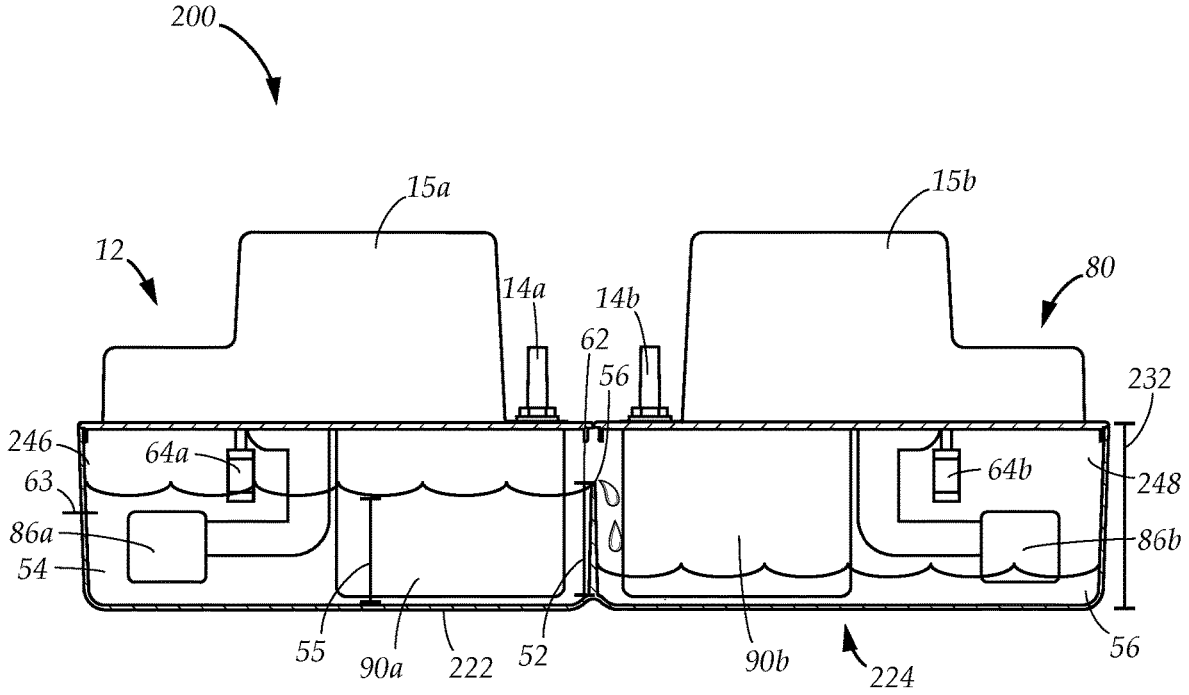
FIG. 18 is a side cross-sectional view of the condensate management system of FIG. 17 illustrating the liquid condensate overflowing from the first compartment to the second compartment in accordance with some embodiments of the present disclosure.

Referring now to FIGS. 14 and 15, according to another aspect of the present disclosure, a condensate management system 200 is presented to manage a liquid condensate (not shown) from an HVAC system in the event of a conventional condensate pump assembly 12 failure. The condensate management system 200 includes a modified pump collection tank 220 including a base 222 having a periphery 224, a top edge 228, and multiple outer walls 230, and a drain outlet 270. The drain outlet 270 bifurcates the modified pump collection tank 220 forming a first compartment 246 configured to receive a conventional condensate pump assembly 12 and a second compartment 248 configured to receive an auxiliary condensate pump assembly 80. The first compartment 246 is in fluid communication with the second compartment via the drain outlet 270. Each of the outer walls 230 extends substantially vertically between the periphery 224 and the top edge 228. The first compartment 246 is configured to collect the liquid condensate (not shown) from a conventional condensate pump assembly 12 of the HVAC system, while the second compartment 248 is configured to receive an overflow of the liquid condensate 154 from the first compartment 246. In some embodiments, the drain outlet 270 includes an overflow wall 50 elevated relative to the base 222 that extends laterally across the modified pump collection tank 220 to define the first compartment 246 and the second compartment 248. The overflow wall 50 includes a recessed upper edge that is lowered with respect to the top edge 228. The height of the overflow wall 50 is less than the height of the outer walls 230, such that an overflow of water may flow from the first compartment 246 to the second compartment 248 without flowing over the top edge 228.

Referring now to FIGS. 14, 15, 16, 17, and 18, in some embodiments, a condensate management system 200 includes a modified pump collection tank 220 forming a first compartment 246, a conventional condensate pump assembly 12, a drain outlet 270 disposed in the first compartment 246, and an auxiliary condensate pump assembly 80 in fluid communication with the drain outlet 270 and configured to receive an overflow 56 of the liquid condensate 54 from the first compartment 246.

In some embodiments, the modified pump collection tank 220 includes a base 222 having a periphery 224, a top edge 228, and multiple outer walls 230 extending substantially vertically between the periphery 224 and the top edge 228 to form the first compartment 246. The conventional condensate pump assembly 12 may be disposed in the first compartment 246 and configured to collect the liquid condensate 54. The drain outlet 270 may be disposed in the first compartment 246 and elevated relative to the base 222. The auxiliary condensate pump assembly 80 may be in fluid communication with the drain outlet 270 and configured to receive an overflow 56 of the liquid condensate 54 from the first compartment 246.

In some embodiments, the overflow wall 50 is disposed transversely between an opposing pair of the outer walls 230. In some embodiments, the overflow wall 50 is substantially planar and is disposed between the first compartment 246 and the second compartment 248 such that the overflow wall 50 defines the second compartment 248. In some embodiments, the first compartment 246 and the second compartment 248 extend successively along the longitudinal axis 238.

In some embodiments, at least a portion of the overflow wall 50 includes a height 52 less than a height 232 of the opposing outer walls 230. In certain embodiments, the overflow wall 50 provides fluid communication between the first compartment 246 and the second compartment 248. In some embodiments, the overflow wall 50 includes a contoured or recessed portion 53 configured to direct an overflow 56 of the liquid condensate 54 from the first compartment 246 to the second compartment 248. In some embodiments, the recessed portion 53 of the overflow wall 50 is configured to direct the overflow 56 from the first compartment 246 to the second compartment 248 via gravity.

In some embodiments, the conventional condensate pump assembly 12 is coupled to the first compartment 246 and the auxiliary condensate pump assembly 80 is coupled to the second compartment 248. The conventional condensate pump assembly 12 and the auxiliary condensate pump assembly 80 may be coupled to the first compartment 246 and the second compartment 248, respectively, by any suitable mechanical device or technique such as a press fit, rivets, grommets, screws, adhesives, and/or the like.

The conventional condensate pump assembly 12 and the auxiliary condensate pump assembly 80 may each include an upper portion 16*a*, 16*b*, a lower portion 18*a*, 18*b*, and a horizontal plate 94*a*, 94*b* configured to cover the respective lower portion 18*a*, 18*b*. In some embodiments, the upper portions 16*a*, 16*b* may each include a housing 15*a*, 15*b* extending in an upward direction relative to the horizontal plate 94*a*, 94*b*. In some embodiments, the housing 15*a*, 15*b* is configured to retain an electric motor (not shown). In certain embodiments, a hose connector 14*a*, 14*b* extends from the horizontal plate 94*a*, 94*b* and is configured to receive a hose or other component of an HVAC system (not shown). In some embodiments, the horizontal plate 94*a*, 94*b* includes one or more inlet ports 82 in fluid communication with the lower portion 18*a*, 18*b*.

In some embodiments, the horizontal plate 94*a*, 94*b* includes one or more pairs of mounting flanges 88*a-d* configured to releasably engage corresponding attachment elements 278*a-d* coupled to or integrated with the modified pump collection tank 220. In other embodiments, the horizontal plate 94*a*, 94*b* is integrated with the top edge 228 of the modified pump collection tank 220.

In some embodiments, the conventional condensate pump assembly 12 and/or the auxiliary condensate pump assembly 80 includes a float assembly 65*a*, 65*b* including a float 86*a*, 86*b* coupled to an alarm 64*a*, 64*b*. In certain embodiments, the float 86*a*, 86*b* includes a foamed thermoplastic or other suitable material configured to float at or near a surface of liquid condensate within the modified pump collection tank 220. The float 86*a*, 86*b* may be configured to provide a liquid level control.

In these and other embodiments, the float 86*a*, 86*b* may pivot vertically to actuate an electric motor (not shown) to release the liquid condensate 54 from the modified pump collection tank 220. In some embodiments, the float 86*a*, 86*b* is mechanically coupled to the alarm 64*a*, 64*b* such that the alarm 64*a*, 64*b* is triggered by the float 86*a*, 86*b* pivoting or moving above a predetermined threshold level 63. In certain embodiments, the alarm 64*a*, 64*b* is triggered in response to actuation of the electric motor (not shown).

In some embodiments, the float assembly 65*a*, 65*b* includes a sensor 61*a*, 61*b* in electronic communication with the alarm 64*a*, 64*b*. The sensor 61*a*, 61*b* may include a motion sensor, a moisture sensor, an optical sensor, and/or any other suitable sensor. In some embodiments, the sensor 61*a*, 61*b* is configured to activate the alarm 64*a*, 64*b* in response to the liquid condensate 54 reaching the predetermined threshold level 63. The alarm 64*a*, 64*b* may include an audible alarm, an electronic notification, and/or a telephone call to a user or owner. In certain embodiments, the electric motor (not shown) and/or the alarm 64*a*, 64*b* may be automatically deactivated in response to the level of liquid condensate 54 within the first compartment 246 or second compartment 248 of the modified pump collection tank 220 dropping below the predetermined level 63.

In operation, in some embodiments, the first compartment 246 is configured to collect the liquid condensate 54 in the event the conventional condensate pump assembly 12 fails.

The liquid condensate 54 may be contained within the first compartment 246 until the level of the liquid condensate 54 exceeds the height 52 of the overflow wall 50. In some embodiments, at least a portion of the overflow 56 may be received into the second compartment 248 via the overflow wall 50. The centrifugal pump 90*b* of the auxiliary condensate pump assembly 80 may be configured to discharge the overflow 56 from the second compartment 248 in the event the conventional condensate pump assembly 12 fails.

It is understood that when an element is referred hereinabove as being "on" another element, it can be directly on the other element or intervening elements may be present therebetween. In contrast, when an element is referred to as being "directly on" another element, there are no intervening elements present. Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

In conclusion, the disclosure is illustrated by example in the drawing figures, and throughout the written description. It should be understood that numerous variations are possible, while adhering to the inventive concept. Such variations are contemplated as being a part of the present disclosure.

What is claimed is:

1. A condensate management apparatus to manage a liquid condensate from an HVAC system in the event of a condensate pump failure, the condensate management apparatus comprising:

a modified pump collection tank comprising a base, a top edge, and a plurality of outer walls extending substantially perpendicularly between a periphery of the base and the top edge;

an elevated platform disposed in the modified pump collection tank comprising a support surface and at least one sidewall extending substantially perpendicularly between the base and the support surface, the support surface configured to support a conventional condensate pump assembly of an HVAC system such that at least a portion of the conventional condensate pump assembly is elevated above the top edge;

a trough disposed within the modified pump collection tank and defined by the at least one sidewall and the plurality of outer walls, wherein the trough is configured to retain liquid condensate from the HVAC system in the event the conventional condensate pump assembly fails; and a drain outlet disposed in one of the plurality of outer walls and in fluid communication with the trough, wherein the drain outlet is configured to direct the liquid condensate towards an auxiliary condensate pump assembly.

2. The condensate management apparatus of claim 1, wherein the drain outlet is substantially aligned with the support surface.

3. The condensate management apparatus of claim 1, wherein the drain outlet is in fluid communication with the auxiliary condensate pump assembly via an inlet port.

4. The condensate management apparatus of claim 3, wherein the drain outlet is elevated relative to the inlet port such that the liquid condensate moves towards the auxiliary condensate pump assembly via gravity.

5. The condensate management apparatus of claim 1, wherein the trough substantially surrounds the elevated platform and the conventional condensate pump assembly.

6. The condensate management apparatus of claim 1, further comprising a float assembly coupled to the conventional condensate pump assembly and disposed in the trough, wherein the float assembly is configured to trigger an alarm in response to a level of the liquid condensate exceeding a predetermined threshold.

7. The condensate management apparatus of claim 6, wherein the alarm comprises at least one of an audible alarm, an electronic notification, and a telephone call.

* * * * *